US011434717B2

(12) United States Patent
Jacob

(10) Patent No.: US 11,434,717 B2
(45) Date of Patent: Sep. 6, 2022

(54) METHOD AND APPARATUS FOR PROVIDING A PLUG WITH A DEFORMABLE EXPANDABLE CONTINUOUS RING CREATING A FLUID BARRIER

(71) Applicant: Gregoire Max Jacob, Houston, TX (US)

(72) Inventor: Gregoire Max Jacob, Houston, TX (US)

(73) Assignee: SOLGIX, INC, Houston, TX (US)

( * ) Notice: Subject to any disclaimer, the term of this patent is extended or adjusted under 35 U.S.C. 154(b) by 27 days.

(21) Appl. No.: 17/275,526

(22) PCT Filed: Oct. 24, 2019

(86) PCT No.: PCT/US2019/057935
§ 371 (c)(1),
(2) Date: Mar. 11, 2021

(87) PCT Pub. No.: WO2020/086892
PCT Pub. Date: Apr. 30, 2020

(65) Prior Publication Data

US 2022/0049573 A1 Feb. 17, 2022

(51) Int. Cl.

| | |
|---|---|
| ***E21B 19/24*** | (2006.01) |
| ***E21B 33/124*** | (2006.01) |
| ***E21B 33/128*** | (2006.01) |
| ***E21B 33/134*** | (2006.01) |
| ***E21B 23/01*** | (2006.01) |
| ***E21B 23/06*** | (2006.01) |
| ***E21B 29/00*** | (2006.01) |
| ***E21B 33/129*** | (2006.01) |

(52) U.S. Cl.
CPC ..... *E21B 33/134* (2013.01); *E21B 19/24* (2013.01); *E21B 23/01* (2013.01); *E21B 23/06* (2013.01); *E21B 29/00* (2013.01); *E21B 33/124* (2013.01); *E21B 33/128* (2013.01); *E21B 33/129* (2013.01); *E21B 33/1285* (2013.01); *E21B 33/1293* (2013.01); *E21B 2200/08* (2020.05)

(58) Field of Classification Search
CPC ..... E21B 19/24; E21B 2200/08; E21B 23/01; E21B 23/0413; E21B 23/06; E21B 29/00; E21B 33/124; E21B 33/128; E21B 33/1285; E21B 33/129; E21B 33/1293; E21B 33/134
See application file for complete search history.

(56) References Cited

U.S. PATENT DOCUMENTS

| | | | |
|---|---|---|---|
| 2,331,532 | A | 8/1940 | Bassinger |
| 5,131,468 | A | 7/1992 | Lane et al. |
| 5,819,846 | A | 10/1998 | Bolt, Jr. |
| 5,984,007 | A | 11/1999 | Yuan et al. |

(Continued)

*Primary Examiner* — Daniel P Stephenson

(57) ABSTRACT

A plug assembly includes an expandable assembly and a locking ring. The expandable assembly is adapted to be deformed radially over the locking ring. The plug assembly is used with an untethered object, which is adapted to contact an inside surface of the plug assembly and, using well fluid pressure, to apply forces to the plug assembly. The forces cause further radial deformation of the expandable assembly, and penetration of an internal surface of the tubing string at least at one point with a gripping portion of the expandable assembly.

24 Claims, 30 Drawing Sheets

(56) References Cited

U.S. PATENT DOCUMENTS

| | | | | |
|---|---|---|---|---|
| 6,220,349 | B1 | 4/2001 | Vargus et al. | |
| 6,394,180 | B1 | 5/2002 | Berscheidt | |
| 7,475,736 | B2 | 1/2009 | Lehr et al. | |
| 8,579,024 | B2 | 11/2013 | Mailand et al. | |
| 8,887,818 | B1 | 11/2014 | Carr et al. | |
| 9,027,655 | B2 | 5/2015 | Xu et al. | |
| 9,033,060 | B2 * | 5/2015 | Xu | E21B 33/129 166/382 |
| 9,062,543 | B1 | 6/2015 | Snider et al. | |
| 9,080,403 | B2 | 7/2015 | Xu et al. | |
| 9,284,803 | B2 | 3/2016 | Stone et al. | |
| 9,309,733 | B2 | 4/2016 | Xu et al. | |
| 9,316,084 | B2 | 4/2016 | Carter et al. | |
| 9,316,086 | B2 | 4/2016 | Van Lue | |
| 9,382,787 | B2 | 7/2016 | Naedler | |
| 9,752,407 | B2 | 9/2017 | Jacob | |
| 9,835,003 | B2 | 12/2017 | Harris | |
| 9,976,381 | B2 | 5/2018 | Martin et al. | |
| 9,988,867 | B2 | 6/2018 | Jacob et al. | |
| 10,385,651 | B2 | 8/2019 | Smith et al. | |
| 10,408,012 | B2 | 9/2019 | Martin et al. | |
| 10,472,927 | B2 * | 11/2019 | Marcin | E21B 34/142 |
| 10,648,275 | B2 | 5/2020 | Dirocco | |
| 10,662,732 | B2 | 5/2020 | Frazier | |
| 11,193,347 | B2 * | 12/2021 | Smith | E21B 23/01 |
| 2008/0169105 | A1 | 7/2008 | Williamson | |
| 2013/0186647 | A1 * | 7/2013 | Xu | E21B 33/129 166/207 |
| 2016/0047195 | A1 | 2/2016 | Snider | |
| 2016/0186511 | A1 | 6/2016 | Coronado | |
| 2017/0145781 | A1 | 5/2017 | Silva | |
| 2018/0171746 | A1 | 6/2018 | Dudzinski | |
| 2019/0048698 | A1 | 2/2019 | Ring | |
| 2020/0032613 | A1 * | 1/2020 | Angman | E21B 33/128 |
| 2021/0332661 | A1 * | 10/2021 | Tonti | E21B 34/14 |
| 2022/0049573 | A1 * | 2/2022 | Jacob | E21B 33/134 |

* cited by examiner

METHOD AND APPARATUS FOR PROVIDING A PLUG WITH A DEFORMABLE EXPANDABLE CONTINUOUS RING CREATING A FLUID BARRIER

BACKGROUND

This disclosure relates generally to methods and apparatus for providing a plug inside a tubing string containing well fluid. This disclosure relates more particularly to methods and apparatus for providing a plug with a deformable expandable continuous ring creating a fluid barrier.

The first five figures (FIGS. 1 to 5) refer to one environment example in which the methods and apparatus for providing a plug inside a tubing string containing well fluid described herein may be implemented and used.

FIG. 1 illustrates a typical cross section of an underground section dedicated to a cased-hole operation. The type of operation is often designated as Multi-Stage-Stimulation, as similar operations are repeatedly performed inside a tubing string in order to stimulate the wellbore area.

The wellbore may have a cased section, represented with tubing string 1. The tubing string contains typically several sections from the surface 3 until the well end. The tubing string represented schematically includes a vertical and horizontal section. The entire tubing string contains a well fluid 2, which can be pumped from surface, such as water, gel, brine, acid, and also coming from downhole formation such as produced fluids, like water and hydrocarbons.

The tubing string 1 can be partially or fully cemented, referred as cemented stimulation, or partially or fully free within the borehole, referred as open-hole stimulation. Typically, an open-stimulation will include temporary or permanent section isolation between the formation and the inside of the tubing string.

The bottom section of FIG. 1 illustrates several stimulation stages starting from well end. In this particular well embodiment, at least stages 4*a*, 4*b*, 4*c* have been stimulated and isolated from each other. The stimulation is represented with fluid penetration inside the formation through fracturing channels 7, which are initiated from a fluid entry point inside the tubing string. This fluid entry point can typically come from perforations or sliding sleeves openings.

Each isolation includes a set plug 6 with its untethered object 5, represented as a spherical ball as one example.

The stimulation and isolation are typically sequential from the well end. At the end of stage 4*c*, after its stimulation 7, another isolation and stimulation may be performed in the tubing string 1.

FIG. 2 depicts a sequential step of FIG. 1 with the preparation of subsequent stage 4*d*. In this representation, a toolstring 10 is conveyed via a cable or wireline 9, which is controlled by a surface unit 8. Other conveyance methods may include tubing conveyed toolstring, coiled tubing. Along with a cable, a combination of gravity, tractoring and pump-down may be used to bring the toolstring 10 to the desired position inside the tubing string 1. In FIG. 2, the toolstring 10 conveys an unset plug 11, dedicated to isolating stage 4*c* from stage 4*d*.

FIG. 3 depicts a sequential view of FIG. 2, where the unset plug has been set (6) inside the tubing string 1, and further perforating has been performed uphole of the set plug 6. Typically, the set plug creates a restriction in the tubing string able to receive after an untethered object such as a ball. The toolstring 10 and cable 9 of FIG. 2 have then been removed from the tubing string.

FIG. 4 depicts a sequential view of FIG. 3, where an untethered object 5 is pumped from surface 3 with the well fluid 2 inside the tubing string 1.

FIG. 5 depicts a sequential view of FIG. 4, where the untethered object 5 lands on the set plug 6 and creates a well fluid isolation uphole compared to downhole of the plug position. Further pumping may increase the fluid pressure uphole of the plug position 6, including on the untethered object 5, of the stage 4*d*. Additional pumping rate and pressure may create a fluid stimulation 7 inside the formation located on or near stage 4*d*. When the stimulation is completed, another plug may be set and the overall sequence of stages 1 to 5 may start again. Typically, the number of stages may be between 10 and 100, depending on the technique used, the length of well and spacing of each stage.

There is a continuing need in the art for methods and apparatus for methods and apparatus for providing a plug inside a tubing string containing well fluid. Preferably, the plug includes deformable expandable continuous ring creating a fluid barrier.

BRIEF DESCRIPTION OF THE DRAWINGS

For a more detailed description of the embodiments of the disclosure, reference will now be made to the accompanying drawings.

DETAILED DESCRIPTION

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention.

Figure 6:
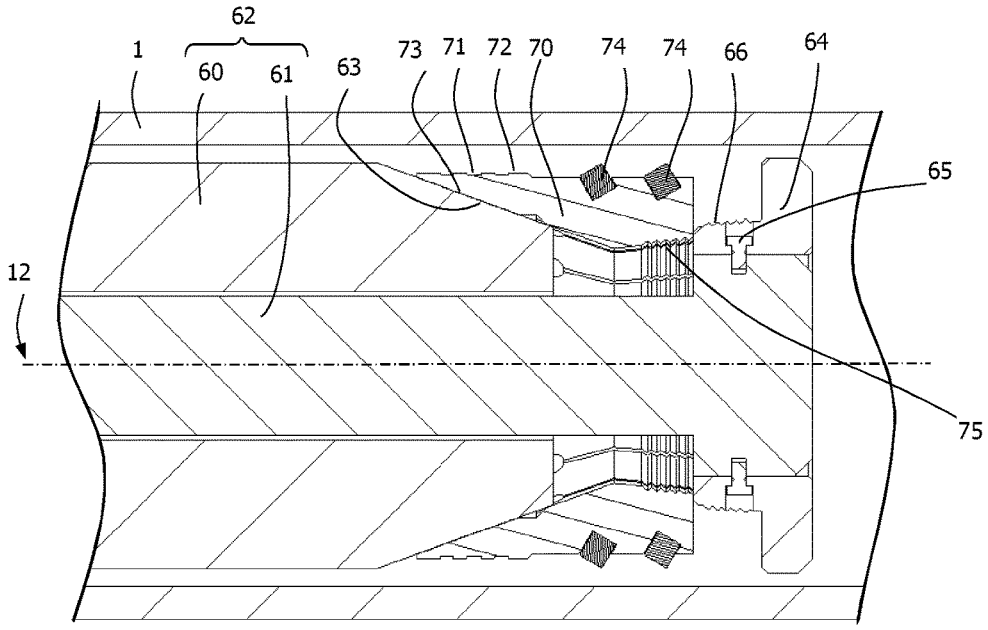
FIG. 6 is a cross-section view of a plug on a retrievable setting tool, in an unset or run-in-hole position inside a tubing string, according to an example embodiment.

FIG. 6 represents a possible embodiment of a plug on a retrievable setting tool. This is a portion of a cut view inside a tubing string 1, depicted around its cylindrical axis 12. The plug is represented in its unset position, which represents the travel, or run-in-hole position.

The retrievable setting tool 62 is represented with two main parts, the mandrel 60 and the rod 61. The rod 61 can slide longitudinally within the mandrel 60, and the movement is preferably activated by a conveyance toolstring, not represented on the figure. The mandrel 60 consists primarily of a cylinder which outside diameter is smaller than the inside diameter of the tubing string 1, to allow free conveyance inside the tubing string. The tip of the mandrel is adapted as a punch having an expansion face 63, which is conical and is matching the inner surface 73 of the continuous expandable ring 70. Preferably, both surfaces 63 and 73 are in contact during the conveyance as depicted in FIG. 6. Also, the continuous expandable ring can include a cylindrical sealing section 72, as main outer surface, and this surface is possibly crenelated, with radial grooves 71 to act as contact relief and to improve surface contacts in case of tubing string surface imperfection or debris presence, such as sand particles. The back of the continuous expandable ring includes the gripping section on its outer diameter, which may include anchoring device such as buttons 74, or slips. On the back inner surface of the continuous expandable ring, a conical surface 75 is present, which includes a radial teeth profile.

An integral locking and back-pushing ring 64 is positioned on the back of the continuous expandable ring. On one inner surface, it includes a conical surface 66 with a radial teeth profile. Both conical surfaces 66 and 75 may have a similar angle, and teeth with similar or proportional spacing. In this conveyance position, the two surfaces 66 and 75 are not in contact with each other.

The integral locking and back-pushing ring 64 includes an attachment with the rod 61 on its inner cylindrical surface. The attachment may be performed with shear screws 65, disposed radially across the two parts. Shear rings may also be used for the same purpose.

The stacking of the two plug parts, namely continuous expandable ring 70 and integral locking and back-pushing ring 64 are configured to stay in place due to mechanical constraint, on the rod 61 and mandrel 60, while under conveyance within the casing string 1.

Figure 7A:
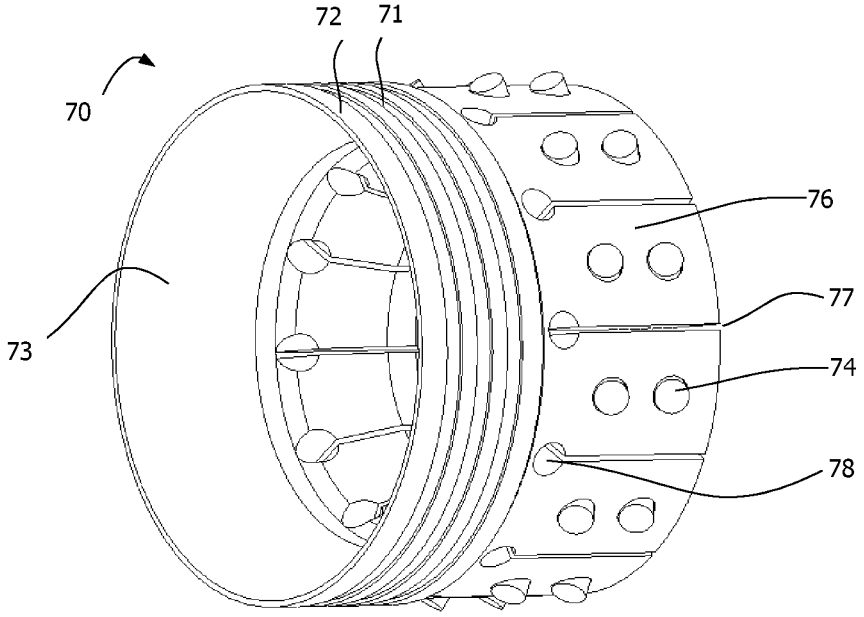
FIGS. 7A and 7B are isometric views of an expandable continuous ring, in its unset position, according to an example embodiment.
Figure 7B:
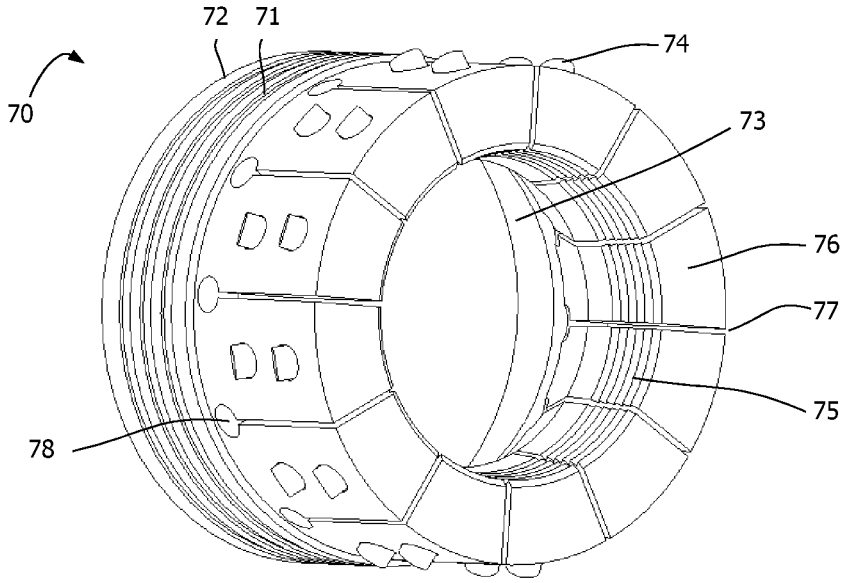

FIGS. 7A and 7B represent two isometric views of the continuous expandable ring. As seen in FIG. 6, the continuous expandable ring 70 may contain two sections, within the same part. The sealing section is characterized by a cylindrical outer surface 72 optionally crenelated with grooves 71. The front inner surface is preferably conical 73. The back section of the ring 70 includes anchoring devices, such as buttons 74. Those buttons are preferably made out of hard metal, ceramic or composite metals, in order to penetrate the inner surface of the tubing string when the plug is actuated. Other anchoring devices include metal slips or a gripping surface. In this embodiment, buttons are distributed around the outer cylindrical surface of the ring. The back section of the continuous expandable ring may include radial slit cuts 77 distributed around the cylindrical shape, creating several slips 76. Preferably, the number of slips is between 4 and 16. Each slip includes its own gripping devices, here depicted with two buttons 74 each. Preferably, each slip may contain between 1 and 8 buttons. At the end of the slit cut 77, a relief hole 78 or feature can be added to allow for the transition of the expandable section by deformation, next to 71 and 72, and the expandable section by radial separation with the slips 76.

In FIG. 7B, additional details can be observed regarding the back surface of the slips 76, preferably flat cut, and the inner conical surface with the teeth 75.

Figure 8:
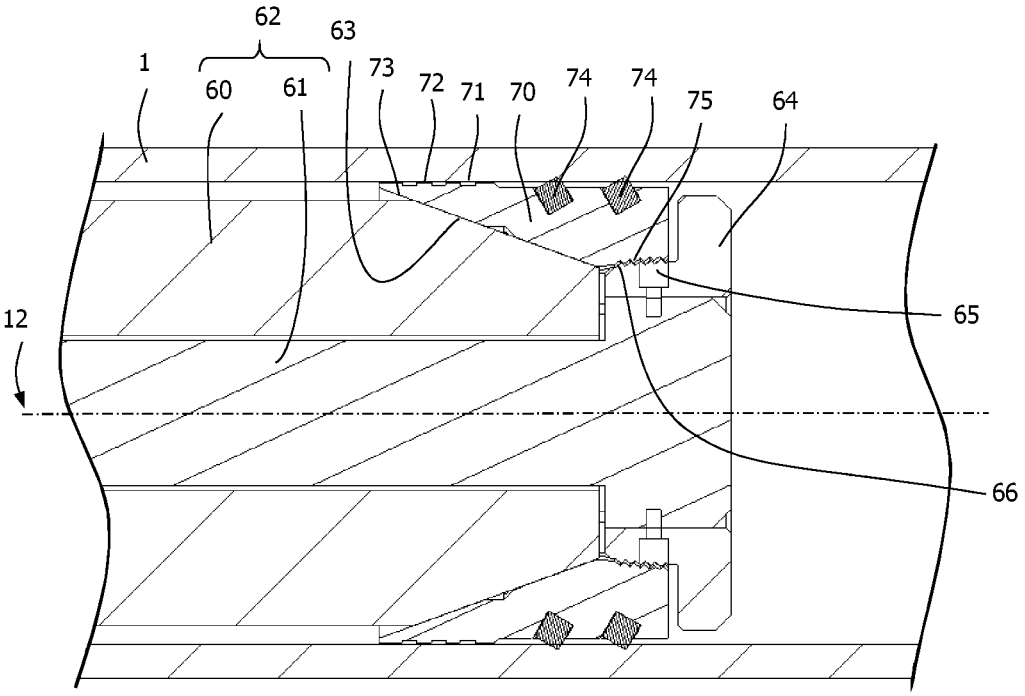
FIG. 8 is a cross-section view of a plug on a retrievable setting tool, after setting tool actuation, with the plug in its set position, according to an example embodiment.

FIG. 8 represents a subsequent step of FIG. 6. In FIG. 8, the plug is set inside the tubing string 1. The conveyance toolstring, not shown, has been actuated, which initiated a longitudinal movement between rod 61 and mandrel 60, along the axis 12. The setting actuation includes the compression of the continuous expandable ring 70 from its back, by the integral locking and back-pushing ring 64, constraining the front portion of the continuous expandable ring 70 to deform plastically over the mandrel expansion face at location 73. The material of the continuous expandable ring may have a high ductility to allow this radial deformation without breaking. In addition, through the compression movement of the back-pushing ring 64, the back section of the continuous expandable ring is expanding and the buttons 74 enter in contact with the inner surface of the tubing string. After reaching this expanded position for the continuous expandable ring 70, the integral locking and back-pushing ring 64 can geometrically fit on the back inner surface 75. At this point of actuation, both surfaces 75 and 66 are in contact. The conical shape of this surface allows further radial expansion of the continuous expandable ring 70, and consequently allows to have the buttons 74 penetrate further inside the tubing string. A force applied by the setting longitudinal movement is preferably between 10,000 and 60,000 lbf [44,500 N to 267,000 N]. Preferably, the maximum setting force is set by the value of the multiple shear screws 65 which may shear when reaching the desired set force.

The teeth on both surfaces 66 and 75 allow to lock the two parts together and constrain the continuous expandable ring 70 in its radially expanded state, anchored on the tubing string 1 at the buttons 74 position. The sealing surface 72 of the continuous expanded ring 70 is also contacting the inner surface of the tubing string 1.

Figure 9A:
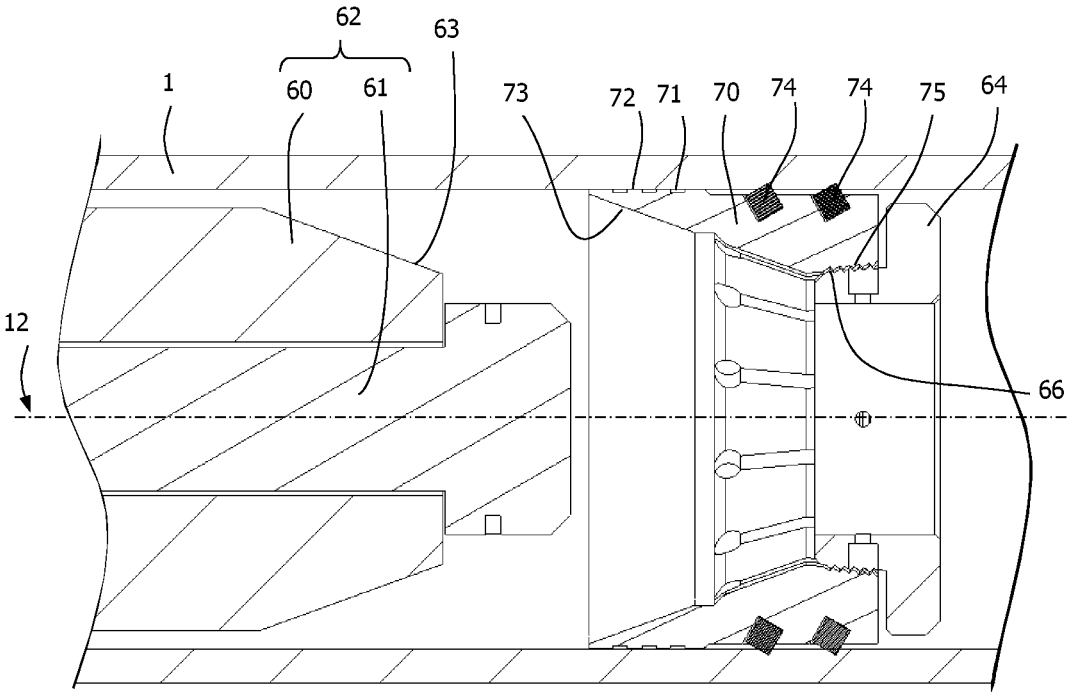
FIG. 9A is a cross-section view of a set plug with the retrievable setting tool being pulled away from the set plug, according to an example embodiment.
Figure 9B:
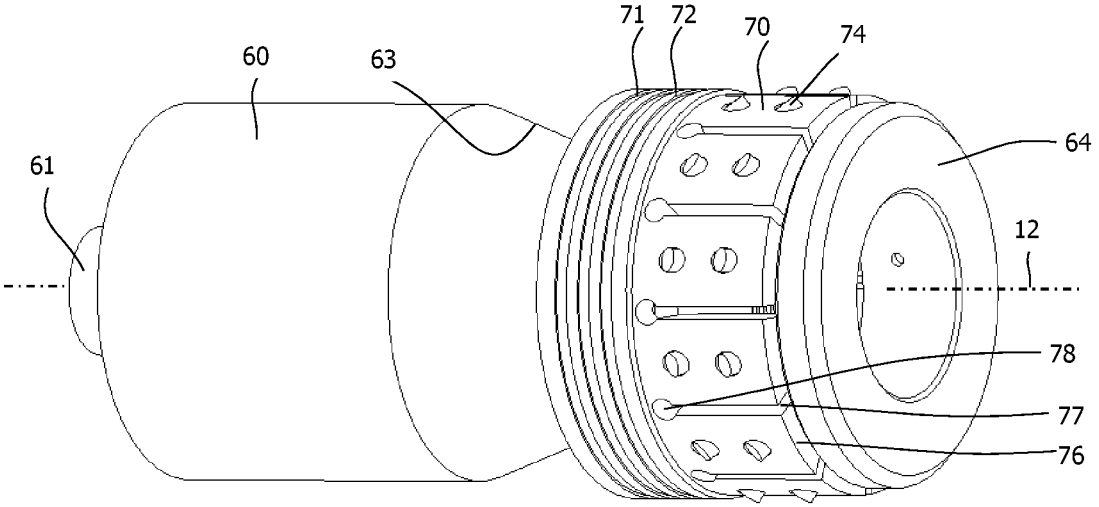
FIG. 9B is an isometric view of the same embodiment as FIG. 9A, without representing the tubing string.

FIGS. 9A and 9B represent the release of the retrievable setting tool 62 from the set plug, with the expanded continuous ring 70 and the integral locking and back-pushing ring 64. FIG. 9A is cut view of the embodiment inside the tubing string 1, along the axis 12. FIG. 9B is an isometric view of the same embodiment without the tubing string.

With the expandable continuous ring in its expanded position and maintained expanded from its back by the integral locking and back-pushing ring, and with interlocking contact along surfaces 66 and 75, the front inner conical surface initially at location 73 can come loose from the mandrel 60. A small force against the elastic compression friction around the surface conical might be necessary to retrieve the rod 61 and the mandrel 60. This force may be preferably below 500 lbf [2,200 N]. Depending on the conveyance method, such as wireline, coiled-tubing, tubing conveyed, the retrievable setting tool 62 along with the rest of the conveyance toolstring, not shown, will be recovered and brought back to surface.

Figure 10A:
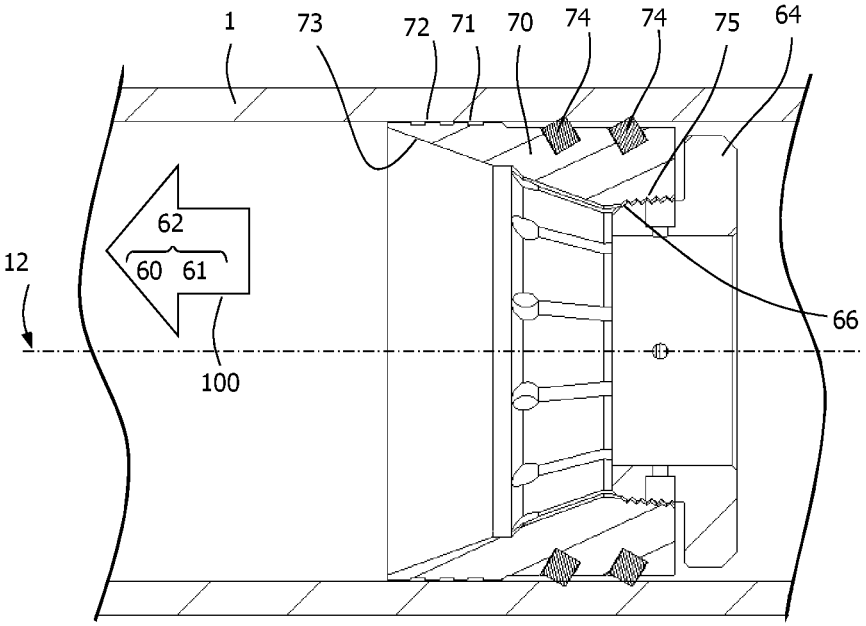
FIG. 10A is a cross-section view of a set plug with the retrievable setting tool being fully retrieved away from the set plug, according to an example embodiment.
Figure 10B:
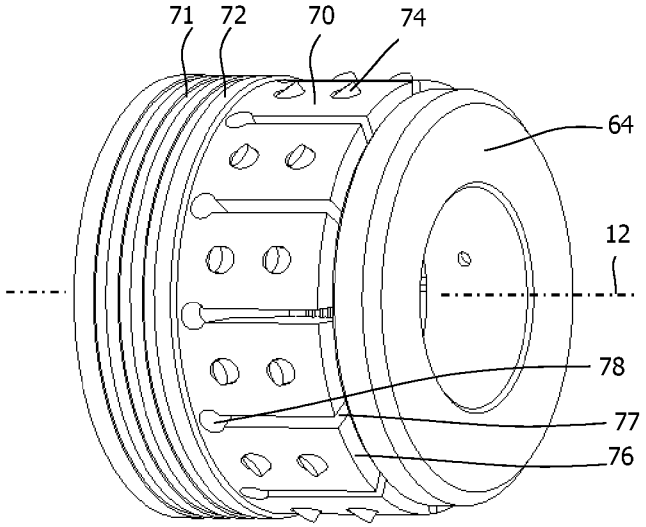
FIG. 10B is an isometric view of the same embodiment as FIG. 10A, without representing the tubing string.

FIGS. 10A and 10B represent the plug set inside the tubing string, with the retrievable setting tool 62 retrieved. FIG. 10A is cut view of the embodiment inside the tubing string 1, along the axis 12. FIG. 10B is an isometric view of the same embodiment without the tubing string, with the retrievable setting tool not seeable on the figure. Noticeable in FIG. 10B, in the set plug position, the gaps formed by the slit cuts 77 are wider after expansion as the corresponding gaps before expansion in FIGS. 7A and 7B.

Figure 11A:
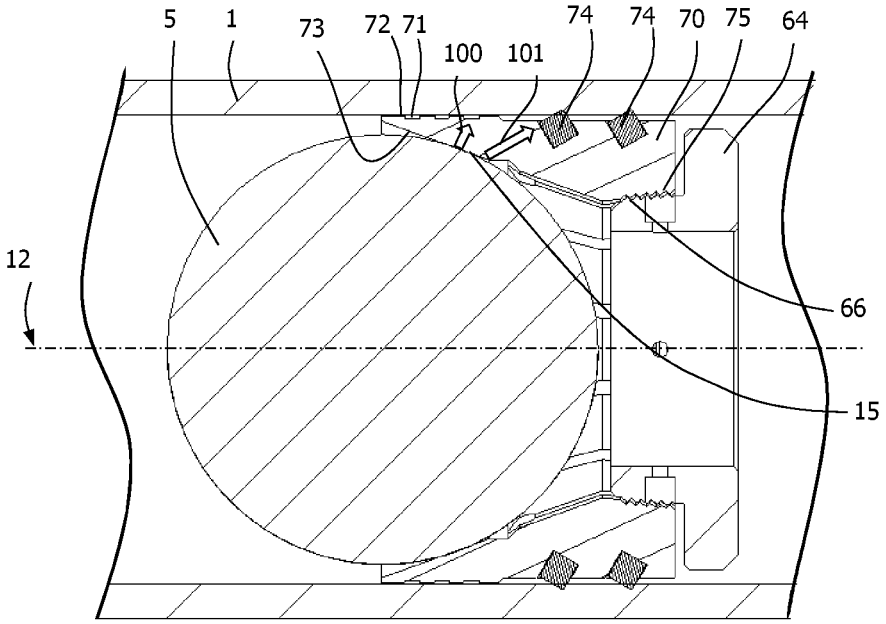
FIG. 11A is a cross-section view of a set plug with the receiving of an untethered object acting on the expandable continuous ring, according to an example embodiment.
Figure 11B:
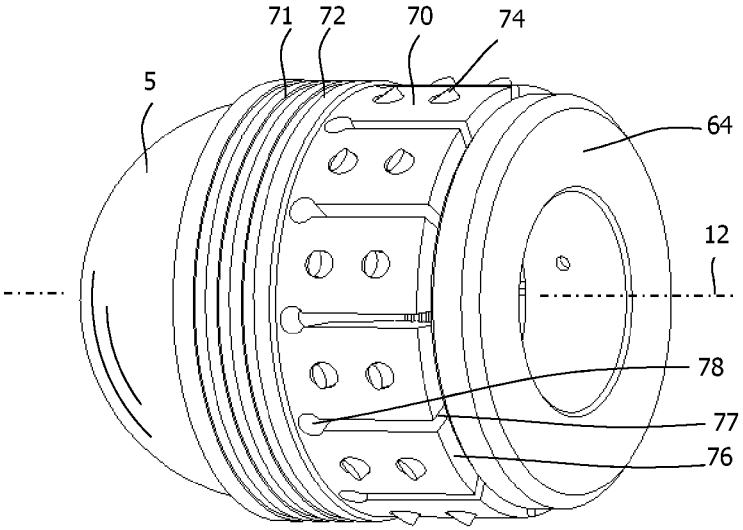
FIG. 11B is an isometric view of the same embodiment as FIG. 11A, without representing the tubing string.

FIG. 11A and FIG. 11B represents a sequential step of FIGS. 10A and 10B. The set plug has received and untethered object 5. This untethered object can be pumped from surface. The untethered object 5 may take the shape of a sphere, a dart, a pill. The untethered object 5 would include at least a hemispherical or a curved section 15, with a curvature higher than the flaring surface 73, preferably conical, of the continuous expandable ring 70.

Note that in other embodiments, the untethered object can be carried within the conveyance adapter, and can be released downhole near the plug setting position. This technique is often referred to as caged ball or ball in place.

FIG. 11A depicts a cut view of the embodiment within the tubing string 1, along axis 12. The hemispherical surface 15 of the untethered object 5 is contacting the conical surface 73 of the inner expandable continuous ring. Through the isolation of the well fluid with its untethered object 5, a pressure differential can appears uphole versus downhole of the set plug (64, 70). This differential pressure, preferably in the order of 500 to 15,000 psi [3.5 MPa to 100 MPa] induces a force on the untethered object. The resultant of this force may be distributed through the contact surfaces 15 and 73, into two forces. One force is represented as arrow 100, for the force directed to the sealing surface 72 of the expandable continuous ring, and the other force is represented as arrow 101, for the force directed to the gripping devices 74 of the anchoring section. The ductility of the material of the expandable continuous ring allows propagating the force radially up to the tubing string, which in comparison is preferably less deformable under similar loading. This distribution into two forces allows ensuring a substantial flow isolation up to a potential complete sealing, depending on the materials combination and pressure available, as well as sustaining the gripping force of the anchoring section through the buttons 74, and substantially fixing the positioning of the plug device within the tubing string.

FIG. 11B represents an isometric view of the same embodiment as in FIG. 11A without the tubing string 1.

Figure 12:
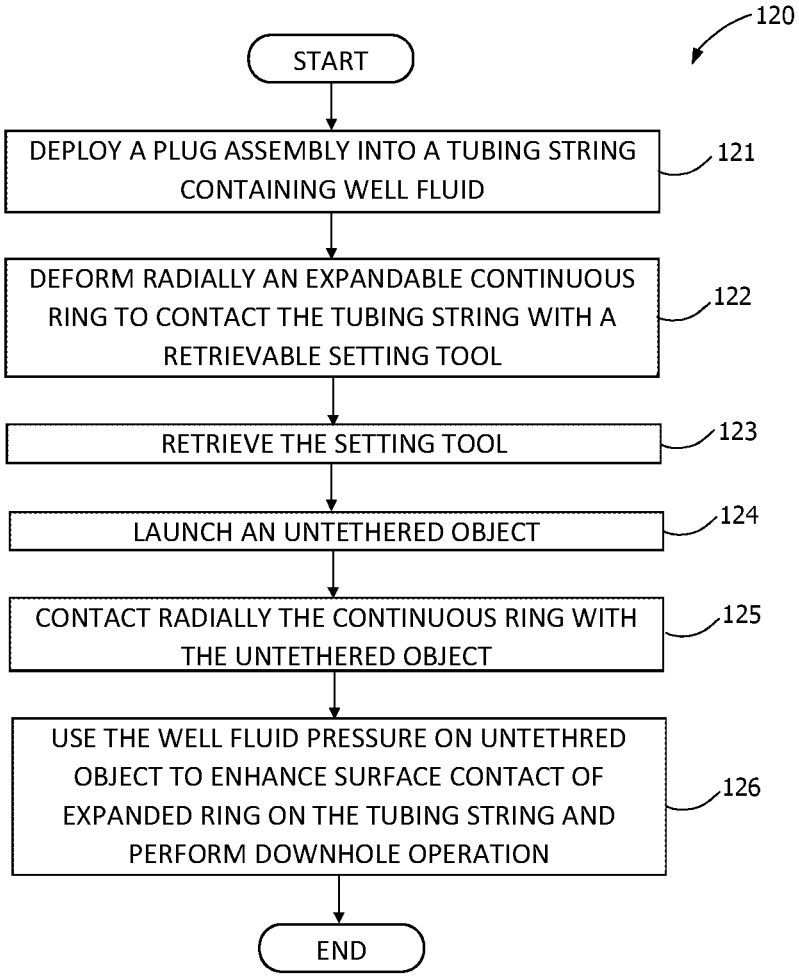
FIG. 12 is a flow diagram representing a technique sequence of deployment of a plug and action of the untethered object on the expandable continuous ring.

FIG. 12 represents an example technique sequence 120, which includes steps depicted from FIGS. 6 to 11. Step 121 corresponds to the deployment of the plug assembly (64,70) into the tubing string (1) containing well fluid (2). On step 122, the plug assembly with its expandable continuous ring 70 is then deformed radially due to the action from a retrievable setting tool 62. At the end of the deformation, at least a portion of the ring 70 will contact the inner surface of the tubing string 1. Then, the retrievable setting tool 62, is retrieved during step 123. Further, an untethered object 5 is launched, such as from surface, inside the tubing string. Then, in step 124, the untethered object 5 reaches the position of the plug set in step 122 and contacts radially its expandable continuous ring 70. Finally, in step 125, the well fluid pressure up-hole of the untethered object (5) is used to act as a force on the expandable continuous ring (70) and consequently enhance its surface contact on the tubing string (1). This isolation state allows performing a downhole operation inside the well.

All parts of the plug, such as expandable continuous ring 70, the integral locking and back-pushing ring 64, untethered object 5, may be built out of a combination of dissolvable materials, whether plastics or metals. Dissolvable materials have the capacity to react with surrounding well fluid 2 and degrades in smaller particles over time. After a period of preferably a few hours to a few months, most or all the dissolvable components have degraded to particles remaining in the well fluid 2.

Figure 13A:
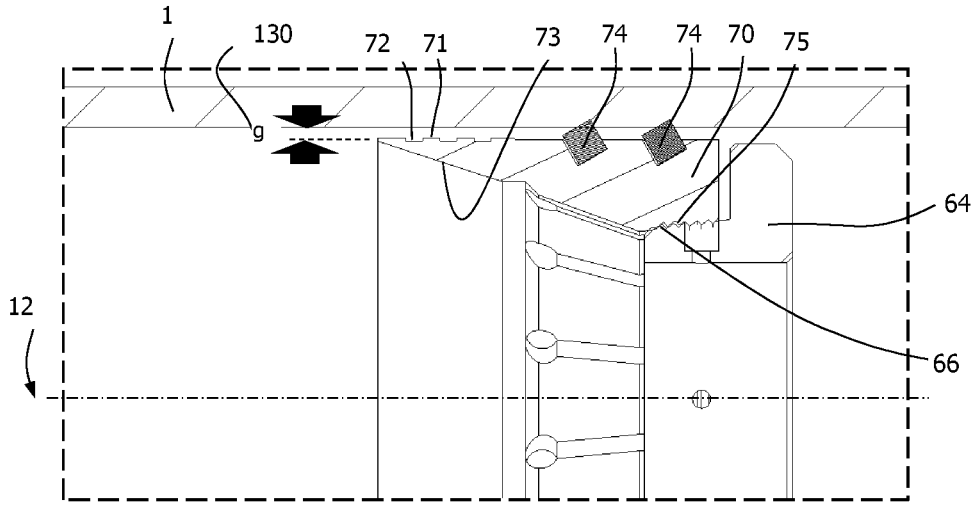
FIG. 13A is a detailed cross-section view of the contact area between the plug and the tubing string before the action of the untethered object, according to an example embodiment.
Figure 13B:
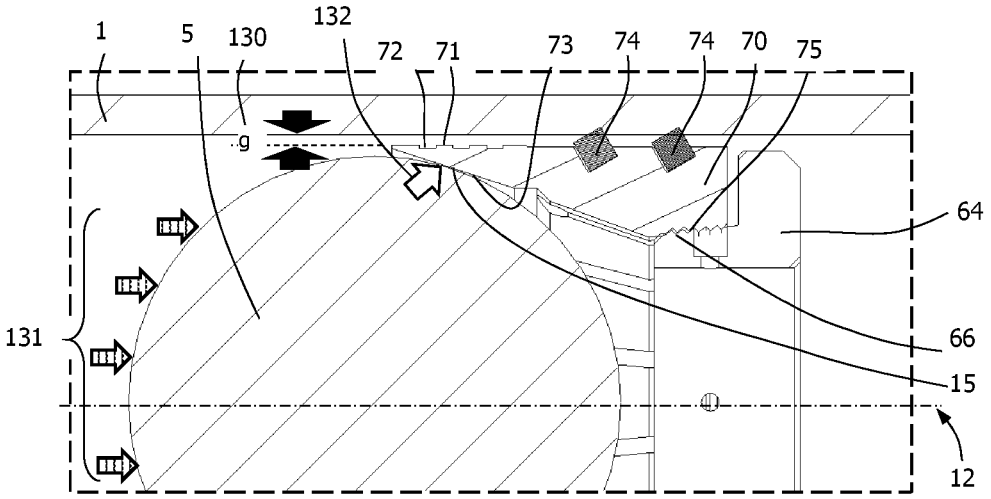
FIG. 13B is a detailed cross-section view of the contact area between the plug and the tubing string at landing of the untethered object contacting the expandable continuous ring, according to an example embodiment.
Figure 13C:
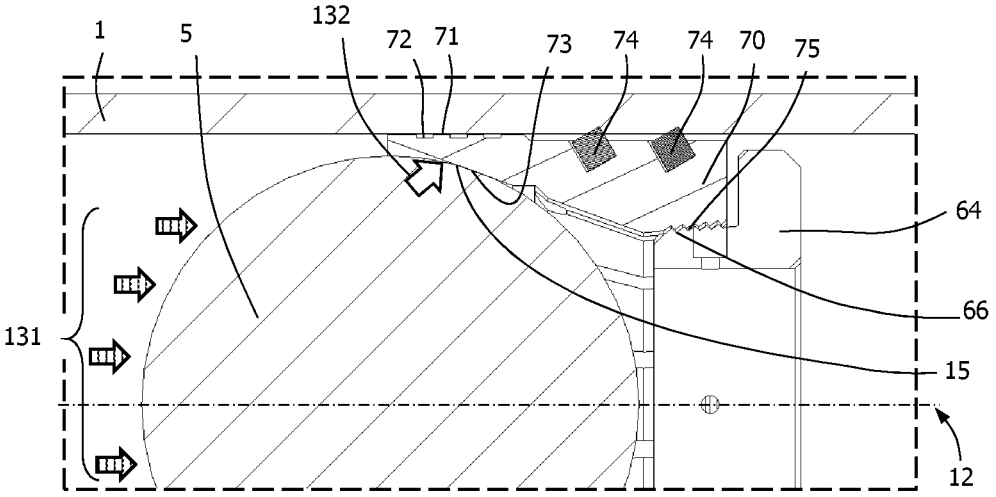
FIG. 13C is a detailed cross-section view of the contact area between the plug and the tubing string, after the pressure action of the untethered object and further expanding of the expandable continuous ring.

FIGS. 13A, 13B, 13C represent a close-up view of the positioning of the expandable continuous ring 70 relative to the tubing string inner surface. FIG. 13A is a variation of the previously depicted FIG. 10A.

The close-up view 13A shows a potential gap 130 between the external expanded surface 72 of the continuous expandable ring 70 relative to the inner surface of the tubing string 1. This gap 130 may be cylindrical around axis 12. This gap 130 may not necessarily be continuous or equal around the inner surface of the tubing string 1. The gap 130 may depend on possible dimensions variations of the tubing string 1 or the expanded continuous ring 70 after expansion, as depicted in FIG. 10A. An additional possibility for the presence of this gap 130 is a potential elastic compression of the continuous expandable ring after its expansion in FIG. 10A with the retrievable setting tool 62. Depending on the material selected for the expandable continuous ring, a combination of plastic and elastic deformations are possible, allowing therefore for a spring-back movement to the expansion provided during the plug setting process.

The other components of the plug keep similar functions as disclosed in the description of FIG. 10A. Gripping devices, such as buttons 74, ensure the anchoring inside the inner surface of the tubing string. Further, the integral locking and back-pushing ring 64 is constraining in position the expanded continuous ring 70 via a toothed conical contact between surface 66 and surface 75. The inner surface 73 may be kept conical.

In FIG. 13B, sequential of FIG. 13A, an untethered object 5 has been launched and has landed on the set plug assembly. The step is similar to FIG. 11A. The difference depicted lies in the gap 130. As depicted in FIG. 13B, the outside surface 15 of the untethered object, preferably including a hemispherical surface, has a diameter allowing to contact continuously the conical surface 73 of the expandable continuous ring 70. The force 131 on the untethered object is caused by a flow restriction and pressure differential created uphole compared to downhole by the plug assembly inside the well fluid 2. As explained in FIG. 11A, the force 131 on the untethered object may be transmitted to the expandable continuous ring through a force 132. The force 132 will be preferably distributed on the conical contact surface 73. Since the continuous expandable ring 70 is fixed through the combination of gripping devices 74 inside the tubing string 1 and secured from its back surface 75 by the integral locking and back-pushing ring 64 with surface 66, it may not move longitudinally, even with the resulting force 132 applied to it. Furthermore, the radial component of the force 132 may contribute to expand the expandable continuous ring 70 further and reduce the gap 130.

FIG. 13C is sequential of FIG. 13B. The figure represents the closing of gap 130 which has ultimately disappeared through the action of force 132. In this view, the outer surface 72 of the expanded continuous ring 70 is contacting the inner surface of the tubing string 1. Optional corrugation, in the form of crenelated grooves 71, may be added to help the contact quality, by providing some volume pocket for potential particles, such as sand or rust, which may be present on the surface and in the well fluid 2. In this representation, the expandable continuous ring is maintained longitudinally in place inside the tubing string thanks to the gripping devices, such as buttons 74, and back locking from the back-pushing ring 64, as described in FIG. 13B.

The untethered object 5 may slide longitudinally slightly further downhole along its curved or hemispherical surface 15, as the conical contact surface 73 may increase in diameter when the force 132 is acting and deforming the continuous expandable ring 70 even more. The longitudinal movement may stop as an equilibrium between the acting forces 131 and 132, with the reaction constraint from the expandable continuous ring 70 and tubing string 1, come to an equilibrium.

Further force 131, transmitted as 132, from the untethered object, may in turn, enhance the sealing contacts between the untethered object 5, the continuous expandable ring 70 and the tubing string 1. This enhanced contact surfaces may globally enhance the sealing of the overall plug inside the tubing string 1, and improve the isolation. Another effect of the further force 132 may be to direct a fraction of this force towards the gripping devices, such as buttons 74, and in turn provide additional anchoring force and globally enhanced gripping of the plug, ensuring its set position inside the tubing string 1.

Figure 14:
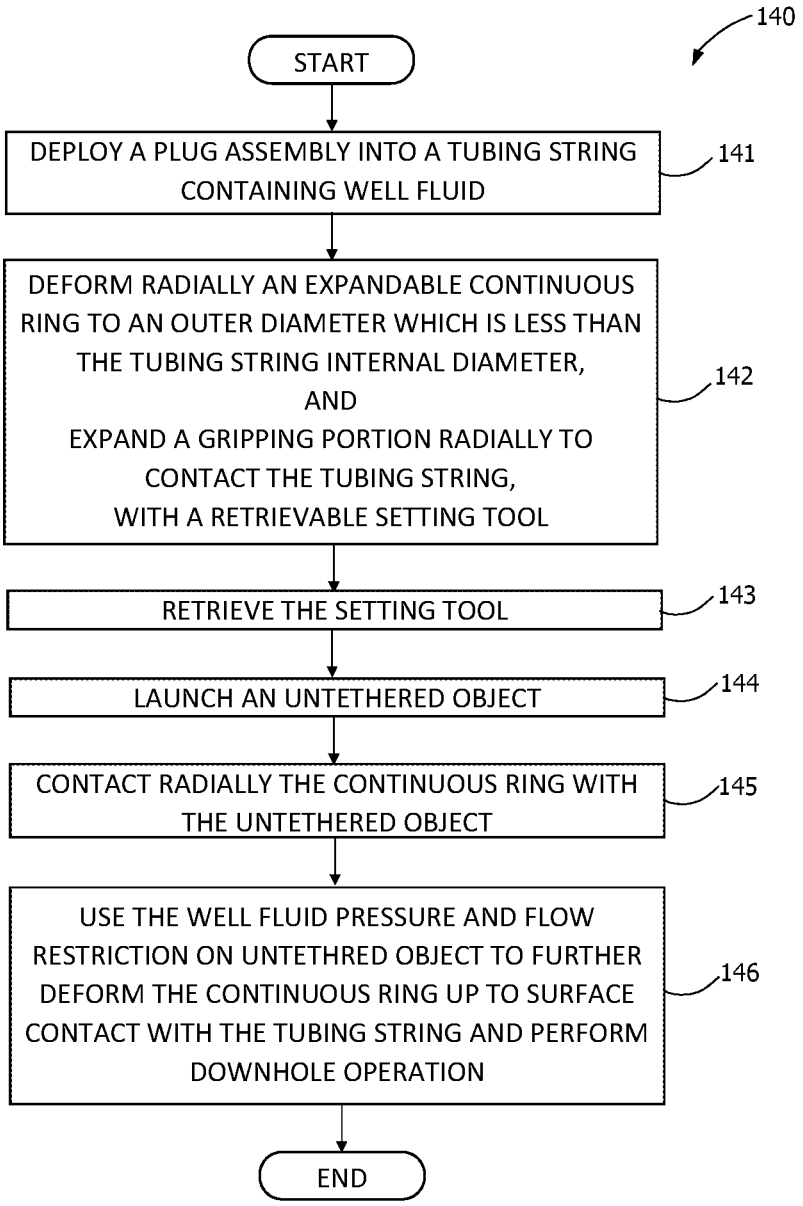
FIG. 14 flow diagram representing a technique sequence of deployment of a plug, with the action of an untethered object for further expanding the expandable continuous ring and contacting a stopping surface on the locking ring.

FIG. 14 represents a technique sequence 140, which includes steps depicted in FIGS. 6 to 11, with the additional features described in FIGS. 13A to 13C.

Step 141 corresponds to the deployment of the plug assembly (64,70) into the tubing string (1) containing well fluid (2). During step 142, the plug assembly with its expandable continuous ring 70 is deformed radially due to the action from a retrievable setting tool 62. During the same step 142, the gripping portion of the expandable continuous ring (70) is expanded radially so that, at least a button (74) of the gripping portion is contacting the inner surface of the tubing string (1), and so that the continuous portion of the expandable continuous ring (70) is deformed to an outer diameter which is less than the tubing string (1) internal diameter. Then, during step 143, the retrievable setting tool (62), is retrieved. Further during step 144, an untethered object (5), is launched, such as from surface, inside the tubing string (1). Then, during step 145, the untethered object (5) reaches the position of the set plug in step 142 and contacts radially its expandable continuous ring (70). Finally, during step 146, the well fluid (2) pressure and flow restriction up-hole of the untethered object (5) are used to apply a force on the expandable continuous ring to further deform it radially up to contact with the tubing string (1). This isolation state allows performing a downhole operation inside the well.

Figure 15A:
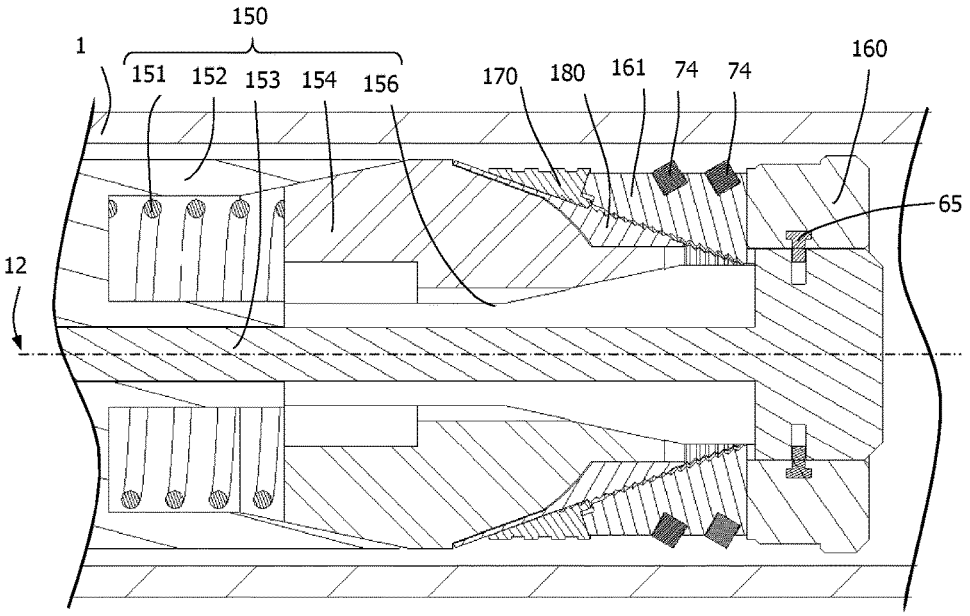
FIG. 15A is a cross-section view of another embodiment with a plug assembly and retrievable setting tool, showing the plug assembly as well as the setting tool in an unset position, or run-in-hole inside a tubing string, according to an example embodiment.

In FIG. 15A, another embodiment is presented.

FIG. 15A represents a possible embodiment of a plug on a retrievable setting tool. This is a portion of a cut view inside a tubing string 1, depicted around its cylindrical axis 12. The plug is represented in its unset position, which represents the travel, or run-in-hole position.

As represented, the plug includes four main parts:

a continuous expandable seal ring 170, an expandable gripping ring 161 which includes one or more anchoring devices, represented as buttons 74, a locking ring 180, a back-pushing ring 160.

In FIG. 15A, the plug main parts are represented unset and undeformed, over the retrievable setting tool 150.

Figure 15B:
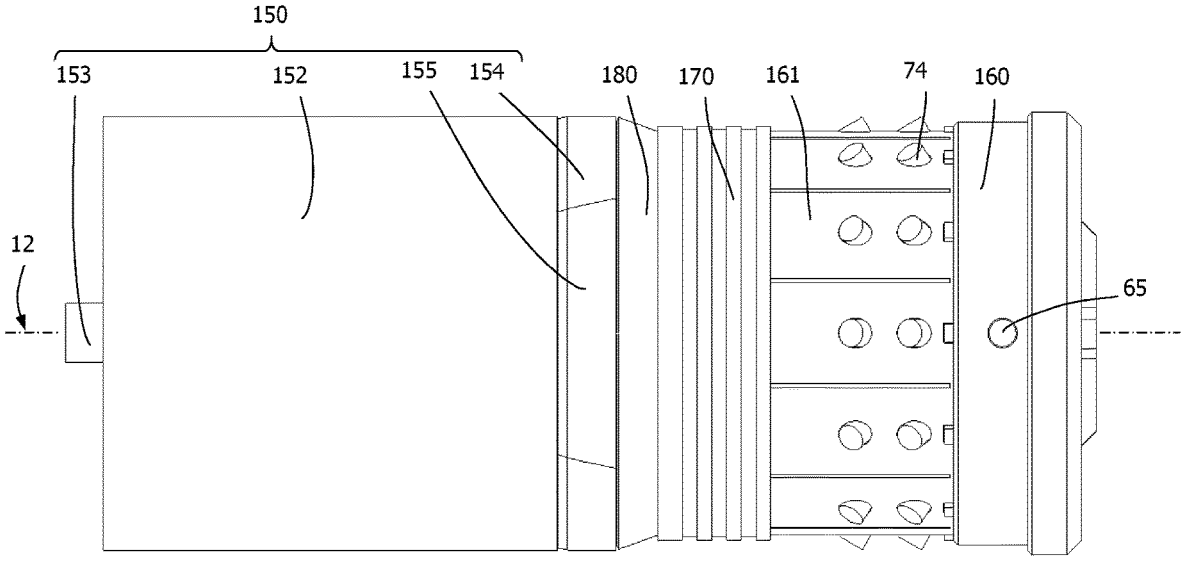
FIGS. 15B and 15C are isometric views at two different viewing angles of the same embodiment as FIG. 15A, without representing the tubing string.

As depicted, the retrievable setting tool 150 includes the following main parts:

a rod 153, which may couple to the back-pushing ring 160 of the plug with one or more shear screw, shear pin or shear ring (65), a housing 152 and a nose 256, which guides the rod 153 longitudinally along the axis 12, a collapsible expansion punch, with multiple azimuthal sections, represented in FIG. 15B with two sections 154 and two sections 155. The four sections have matched cut side planes so that the overall shape of an expansion face towards the locking ring 180, is continuous with a combination of conical and hemispherical shapes. The segmented conical sections 154, 155 are held radially in place within the housing 152 and the nose 156, a compression spring 151 may apply a force outward axially on the upper surfaces of the sections 154 and 155, while being secured longitudinally and radially by the housing 152 and the nose 156.

Figure 15C:
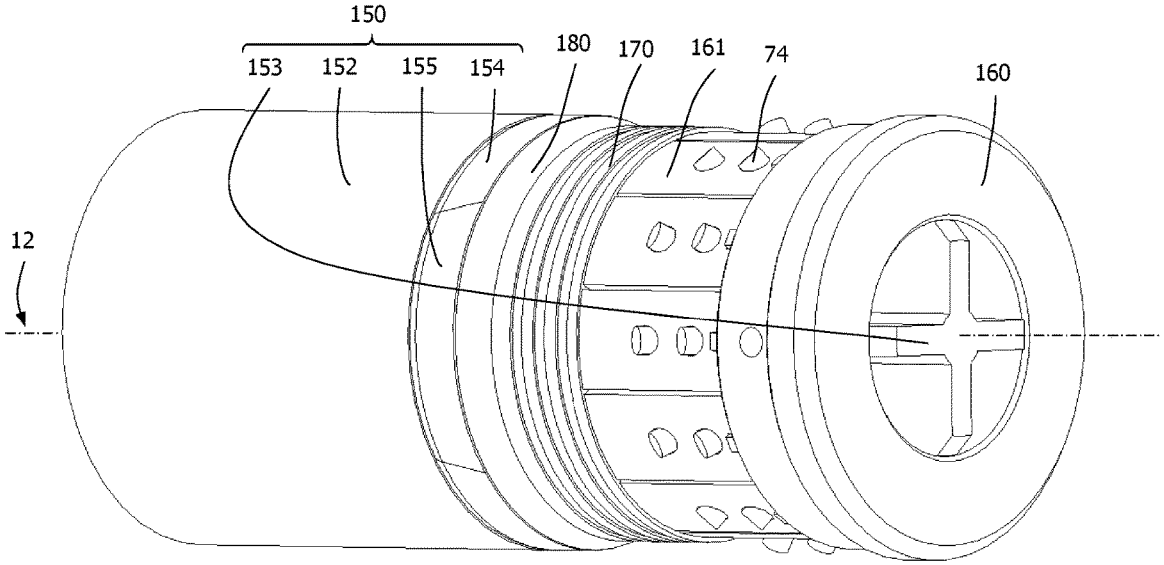

FIG. 15B and FIG. 15C depict the same embodiment as 15A, without the tubing string 1. FIG. 15B presents the embodiment as a straight front isometric view. FIG. 15C presents the embodiment at an angled isometric view. The same components as in FIG. 15A, namely 152, 153, 154, 155 can be observed constituting the retrievable setting tool 150. Regarding the plug, components 170, 180, 161 and 160 can also viewed from both isometric views.

Figure 16A:
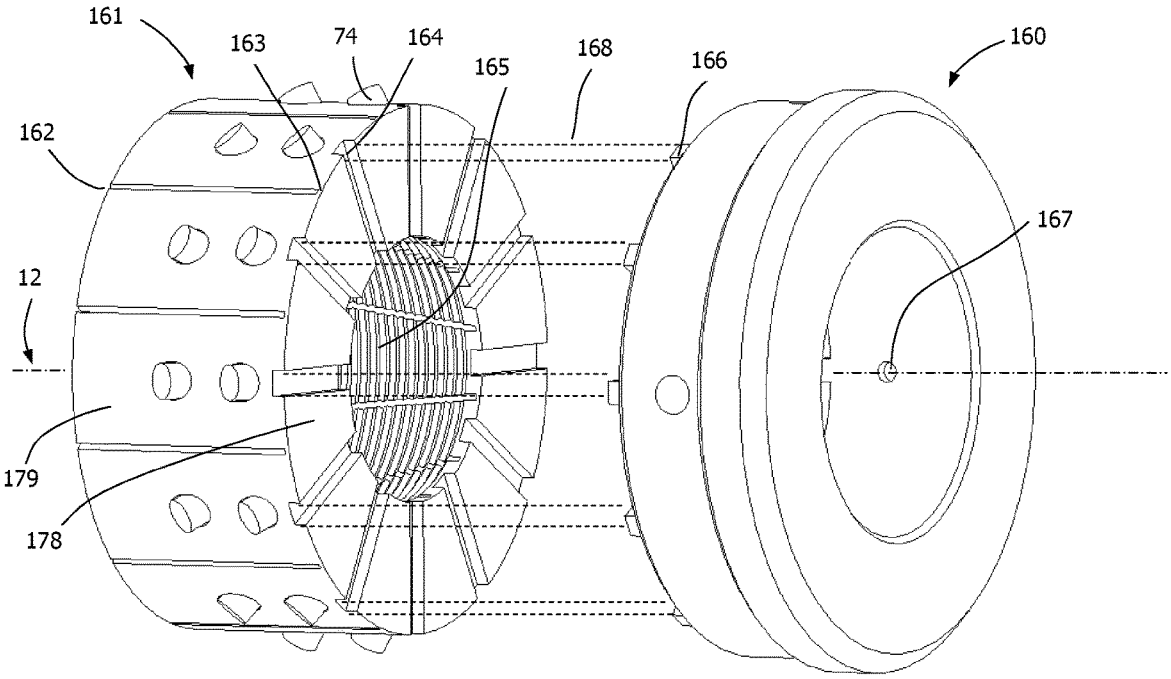
FIG. 16A is an isometric view of an expandable gripping ring and an isometric view of a back-pushing ring, in the same viewing direction, according to an example embodiment.
Figure 16B:
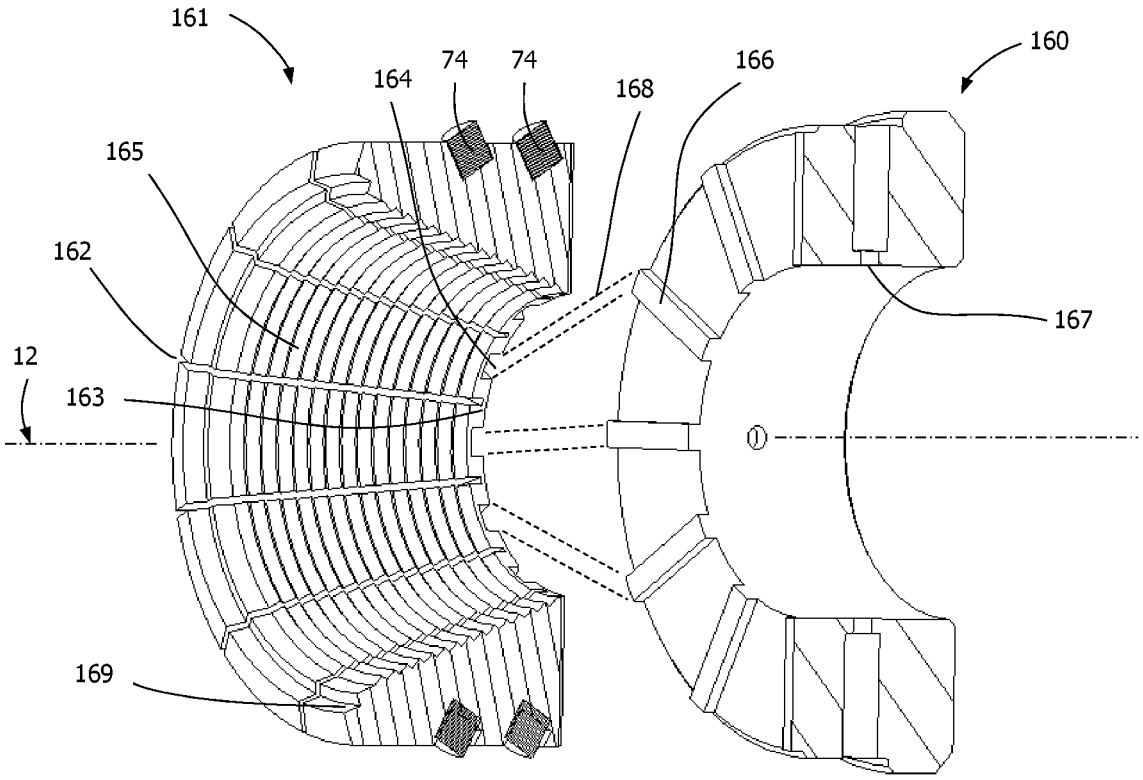
FIG. 16B is a cross-sectional isometric view of the same parts represented in FIG. 16A, from a different viewing angle, according to an example embodiment.

FIGS. 16A and 16B show detailed views of two parts of the plug: the expandable gripping ring 161 and the back-pushing ring 160. FIG. 16A represents an isometric view of both parts within the same orientation along axis 12. FIG. 16B represents another isometric view of both parts seen as a cut view, along axis 12.

The expandable gripping ring 161 can be built with a preferably cylindrical outer shape separated by slit cuts 162. The slit cuts 162 separate the expandable gripping ring in the same numbers of ring sections 179. The ring sections 179 are kept together as a single part, in the unexpanded state, through a thin section 163, each positioned at the opposite end of the slit cuts 162. Preferably, the number of slit cuts 162, as well as ring sections 179 and thin sections 163, is between 4 and 16. The preferably cylindrical outer shape may contain one diametrical dimension around axis 12, or several sub-cylindrical faces with potentially larger outer curvatures for each ring section 179. The adaptation of the curvatures may be needed to cope with the expanded shape which might be closer to the inside diameter of the tubing string. Other possible features on each or on some of the ring sections 179 are anchoring devices such as buttons 74. Alternatively, slip teeth or rough surfaces, can be used as anchoring devices and be present on the outer surface of the ring sections 179. The purpose of the anchoring devices 74 is to penetrate the inner surface of the tubing string 1 to provide a local anchoring. Alternatively, the anchoring devices may increase the surface friction between the expanding gripping ring 161 and the inner face of the tubing string to an adherence point. The number of buttons 74 may preferably be between 1 and 10 for each ring section 179.

The bottom surface 178 of the expandable gripping ring 161 may include radial directing rails 164. Those rails 164 may preferably be positioned in the center of each ring sections 179.

The back-pushing ring 160 may have the counter shapes of the rails 164, protruding out as radial bars 166.

The two parts 161 and 160 may have therefore a matching feature between each other's, symbolized by the alignment 168.

The inner surface of the back-pushing ring may be cylindrical with openings 167 allowing to position shear screw, shear pins or shear rings.

FIG. 16B allows seeing the possible inner surface of the expandable gripping ring 161, with a principal conical shape, containing teeth or other anti-backing feature 165. The front part of the conical shape 165 may include a groove 169.

Figure 17A:
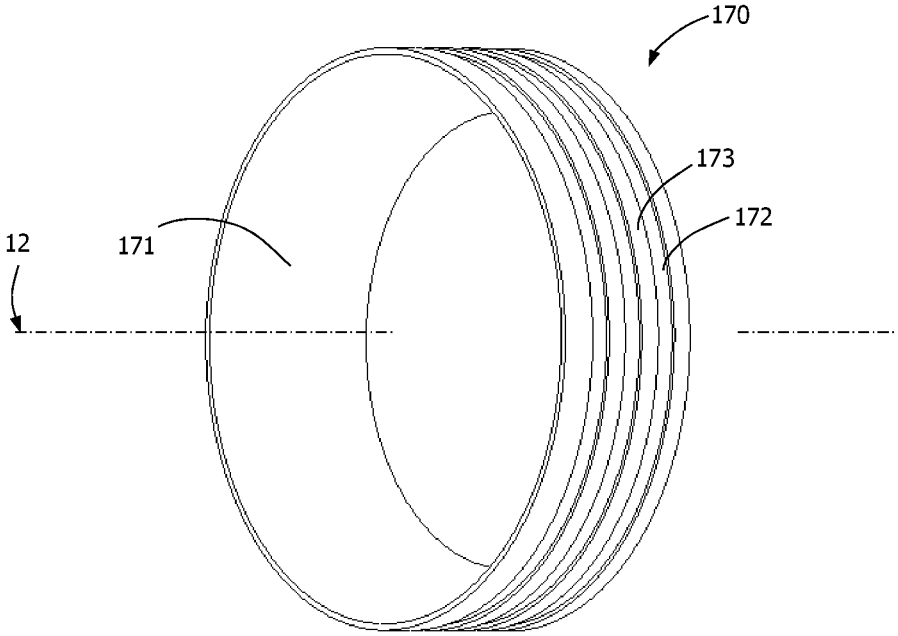
FIG. 17A is an isometric view of an expandable continuous seal ring, according to an example embodiment.

FIG. 17A represents an isometric view of the continuous expandable seal ring 170. As main features represented, the outer surface 173 may be cylindrical, along axis 12. Potential crenelated groove features 172 may be added on this cylindrical surface 173. The inner surface of continuous expandable seal ring 170 may be conical 171.

Figure 17B:
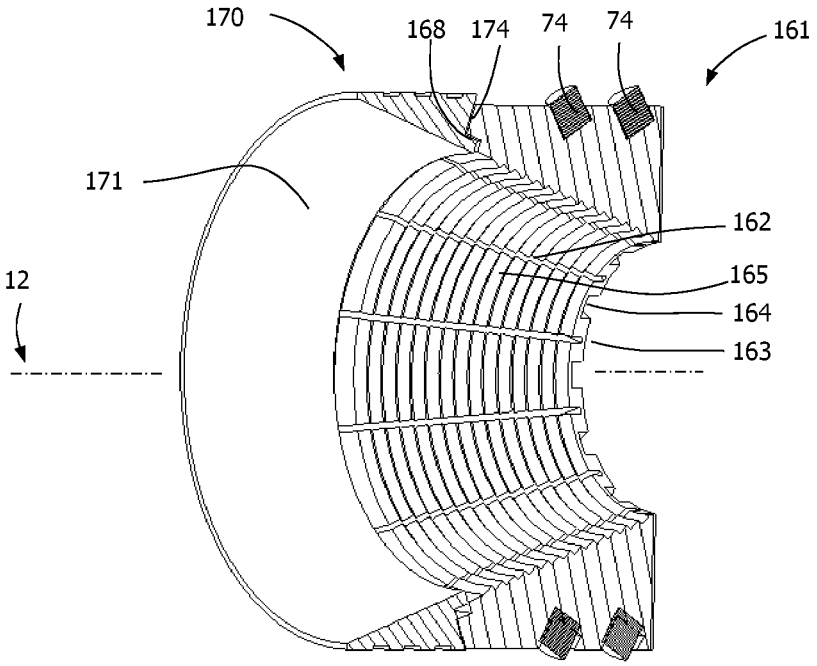
FIG. 17B is a cross-sectional isometric view of the expandable continuous seal ring position next to a cross sectional isometric view of the expandable gripping ring, as the two parts would be positioned in an unset or run-in-hole position, according to an example embodiment.

FIG. 17B represents an isometric cut view of both the continuous expandable seal ring 170 and the expandable gripping ring 161. The position represented is the assembly in the unset, run-in-hole position, as shown in FIG. 15A. The two parts 170 may share a common contact surface 174, which may be a cylindrical, annular, or conical contact. The two surfaces 171 and 165 may have the same conical angle, as referred to axis 12. A preferred angle may be between 5 and 30 degrees. As an additional alignment or positioning feature, the groove 169 of the expandable gripping ring 161 may match the counter form 168 on the continuous expandable seal ring 170.

Figure 18A:
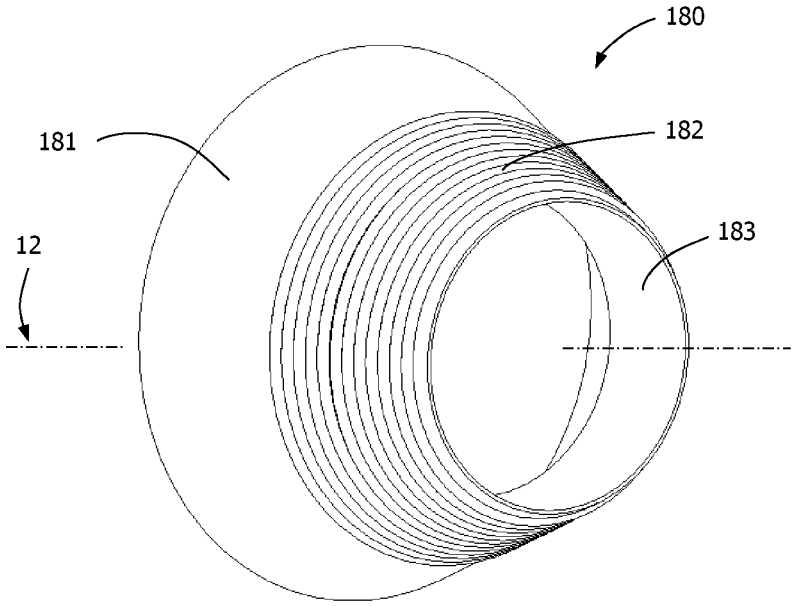
FIG. 18A is an isometric view of a locking ring, according to an example embodiment.
Figure 18B:
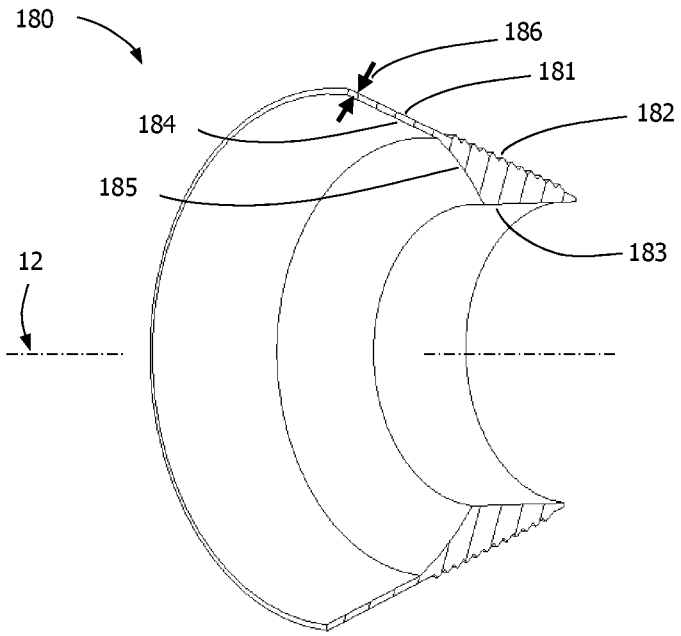
FIG. 18B is a cross-sectional isometric view of a locking ring, according to an example embodiment.

FIG. 18A and FIG. 18B represent the isometric view and cut view of the locking ring 180.

The locking ring 180 may include on its external surface conical surfaces 181 and 182. The angle of the conical surfaces 181 and 182 may be similar to the angle of the surface 171 of the continuous expandable seal ring 170 and of the surface 165 of the expandable gripping ring 161. The conical surfaces may include a slick conical surface 181 and rough conical surface 182, which may include teeth or corrugated features with a matching pattern compared to surface 165 of the expandable gripping ring 161

The inner surface of the locking ring 180 may include a conical surface 184. With the front section of the locking ring 180 having both an external 181 and internal 184 conical surfaces, it results in a funnel feature. The thickness 186 between both conical surfaces may be thin, in the order of 0.1 in to 0.5 in [2 mm to 12 mm]. Further inside the inner surface of the locking ring 180, the conical surface 184 may transition to a hemispherical surface 185 (i.e, a stopping inner surface). The back inner surface may then transition to a cylindrical surface 183.

Figure 19:
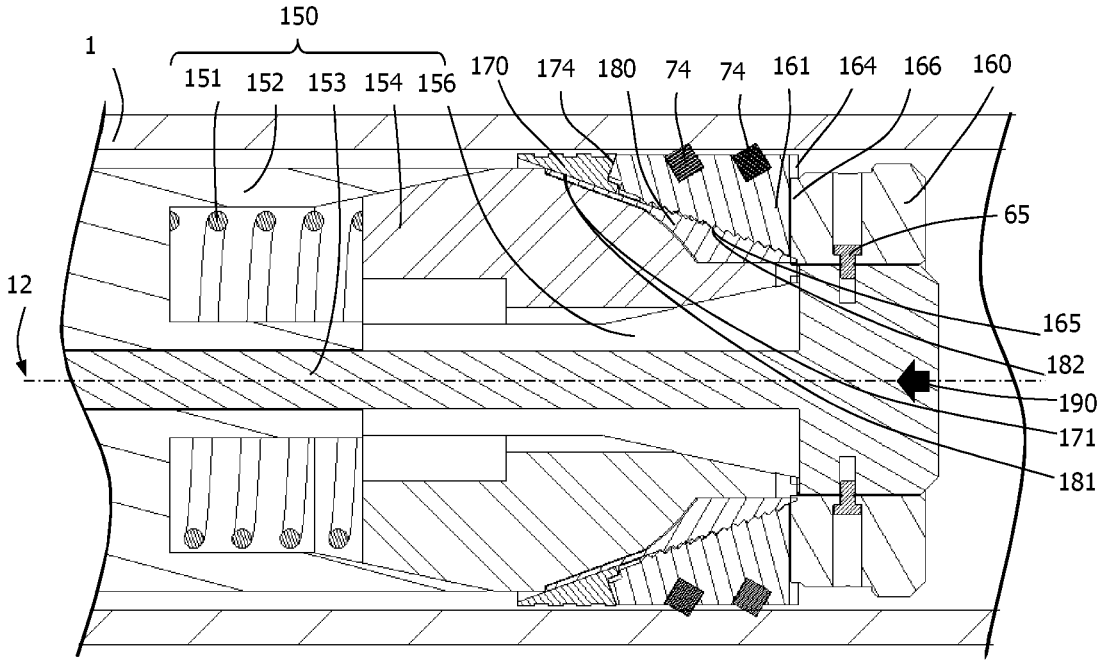
FIG. 19 is a cross-section view of plug assembly in a set stage inside a tubing string with a retrievable setting tool having expanded the expandable assembly.

FIG. 19 represents a sequential view of FIG. 15A, representing the plug in a set stage. FIG. 19 is a cut view of the set plug with actuated retrievable setting tool 150 inside the tubing string 1.

Figure 1:
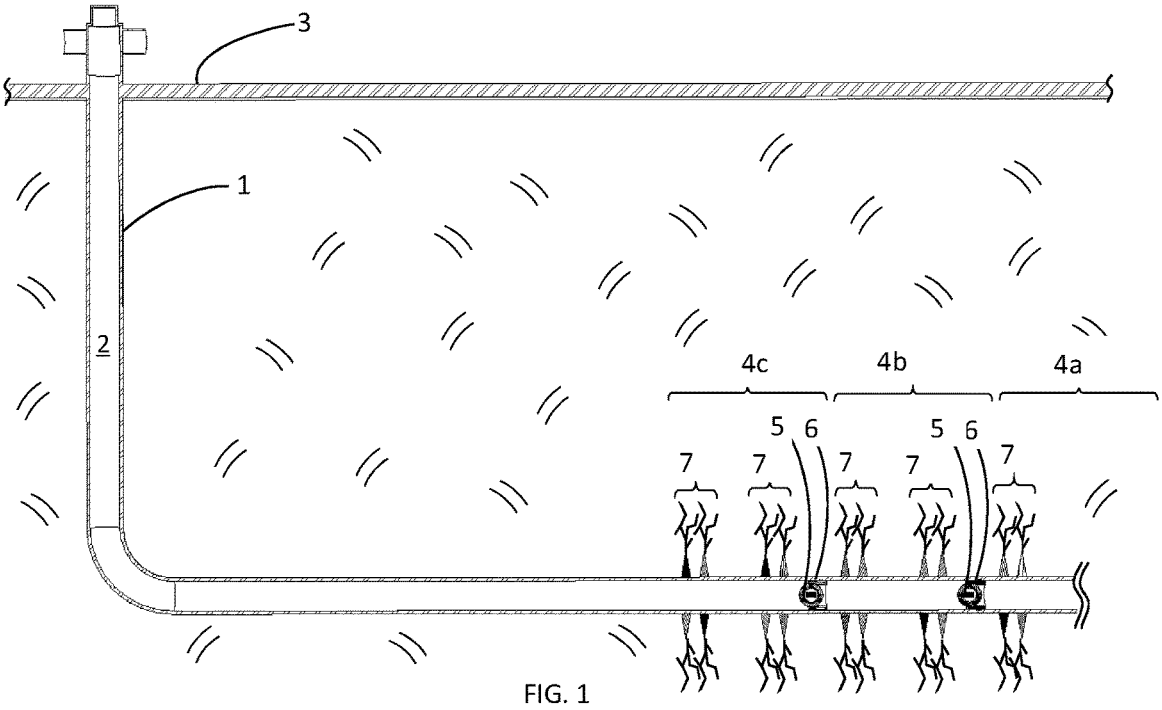
FIG. 1 is a wellbore cross-section view of typical Multi-Stage-Stimulation operation ongoing, with three stages completed.
Figure 2:
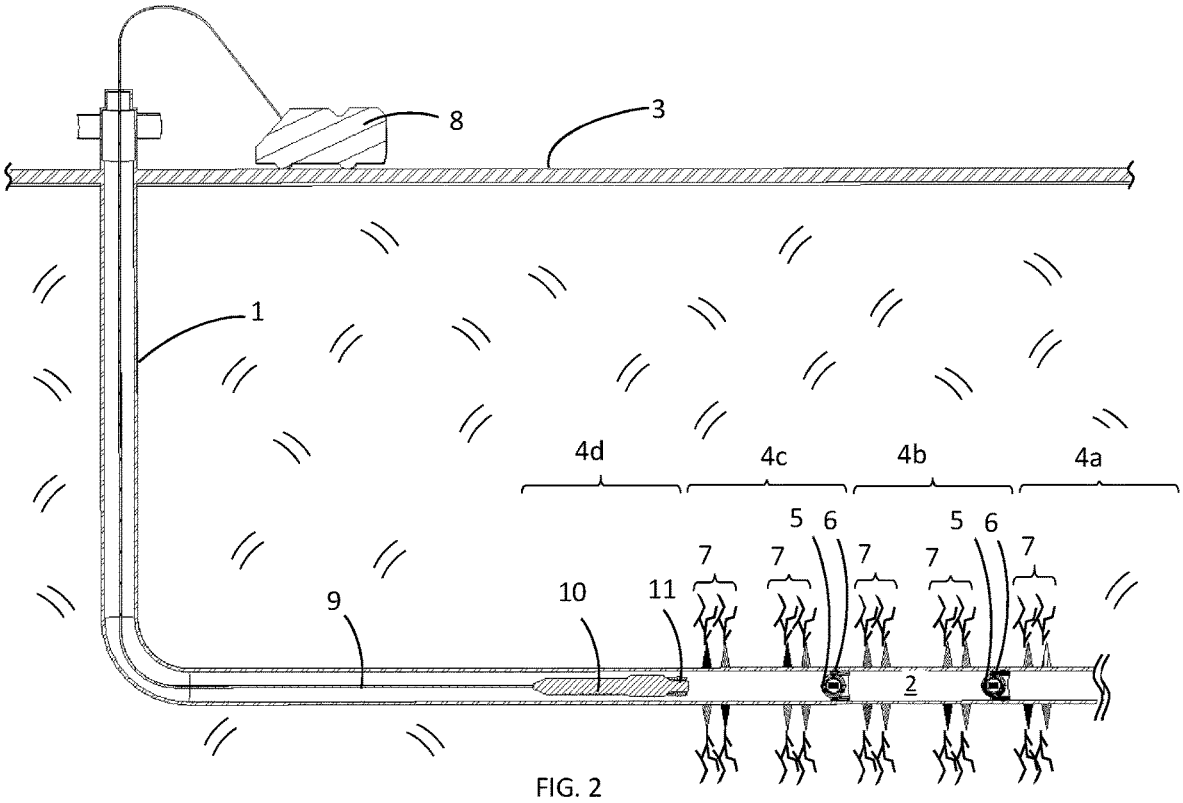
FIG. 2 is a wellbore cross-section view of toolstring conveyance to install the third isolation device for the fourth stage.
Figure 3:
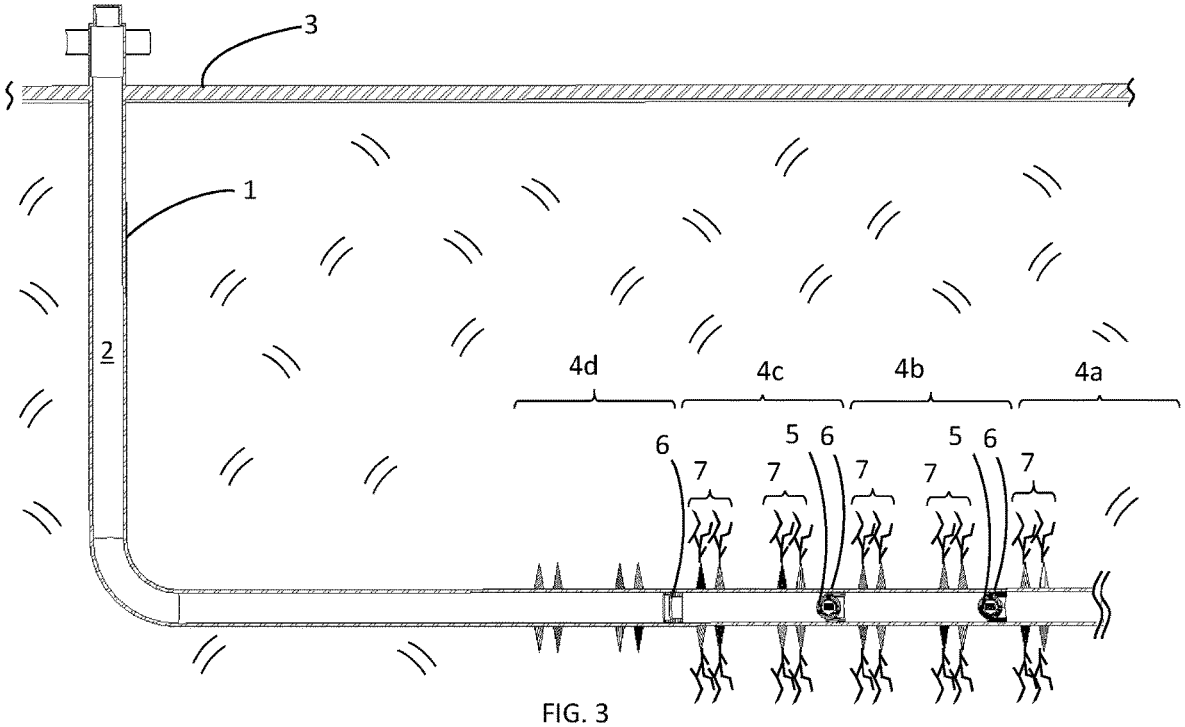
FIG. 3 is a wellbore cross-section view of the third stage isolation device being set and the fourth stage being perforated.
Figure 4:
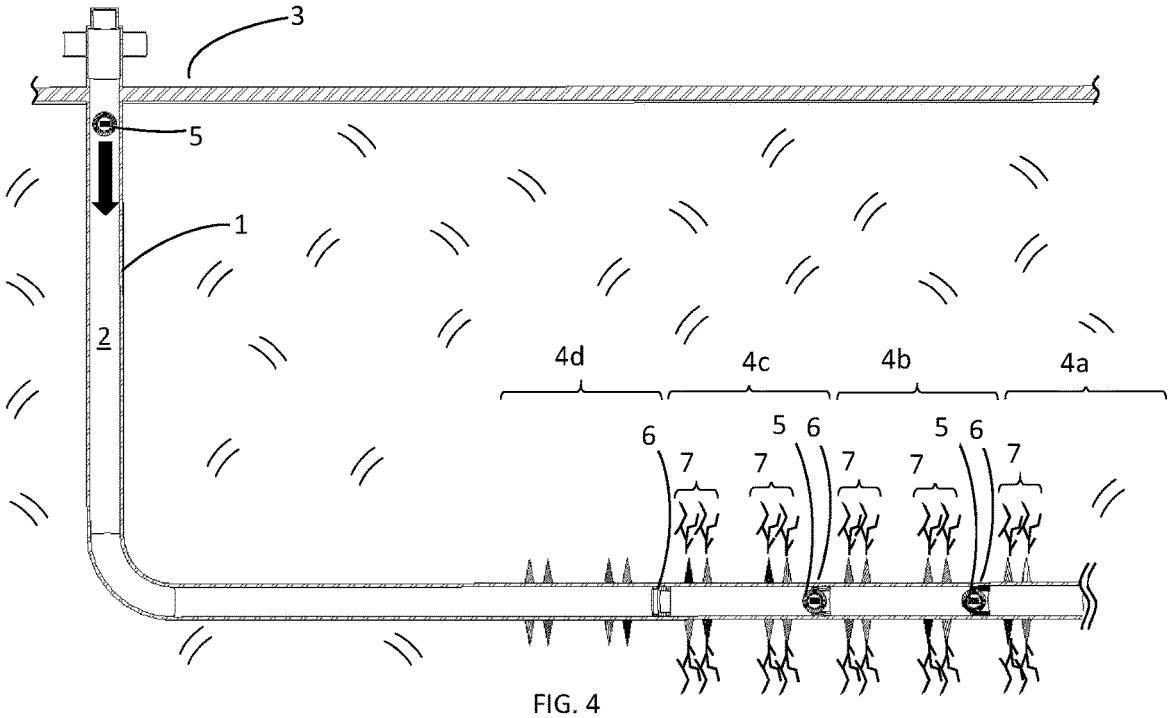
FIG. 4 is a wellbore cross-section view of an untethered object being dropped inside the well and moving towards the third isolation device through the perforated area.
Figure 5:
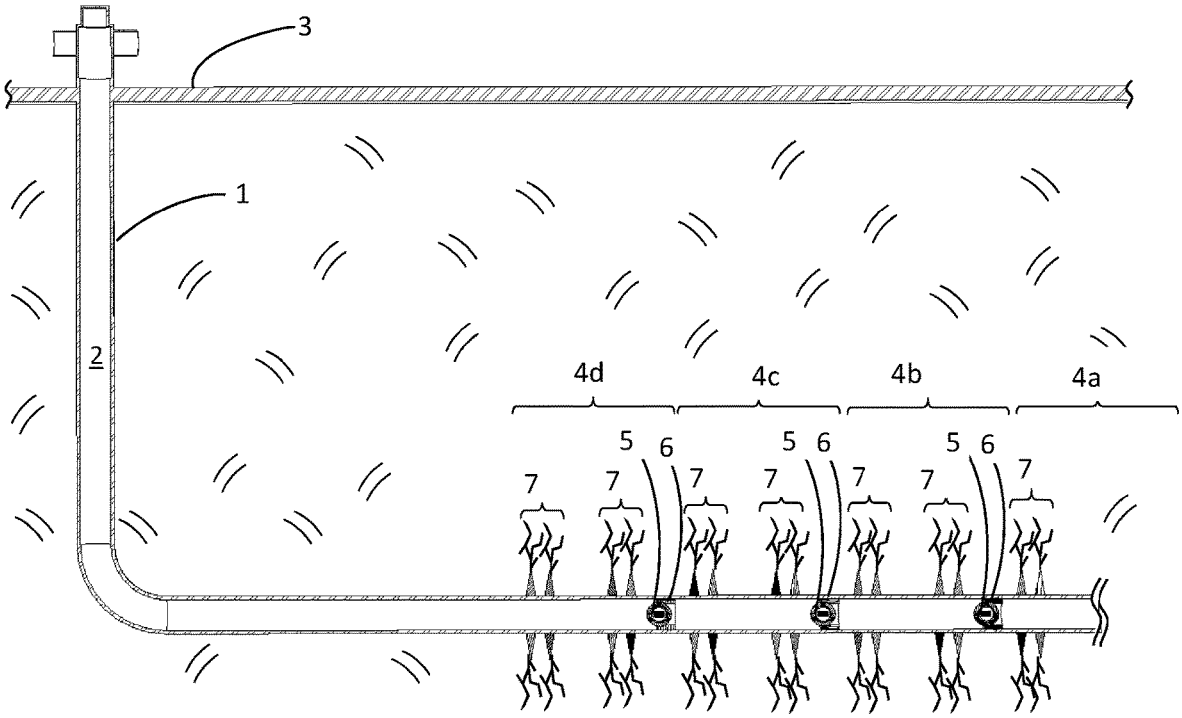
FIG. 5 is a wellbore cross-section view of the fourth stage isolated from the third stage by a plug and untethered object, and completed with pressure pumping operation.

Compared to FIG. 15A, a longitudinal movement 190 of the rod 153 has occurred compared to the other parts 151, 152, 154, 155, 156 of the retrievable setting tool 150. This longitudinal actuation 190 is preferably performed by an actuation tool as part of the toolstring 10, as depicted in FIG. 2.

The consequence of the rod movement 190 is a similar movement for the back-pushing ring 160, which is linked with the rod 153 by shearing devices 65. The longitudinal movement of the back-pushing ring 160 induces in turn the expansion of the expandable gripping ring 161.

The expansion of the expandable gripping ring 161 occurs while traveling on inner conical surface 165 over the matching conical surfaces 182 and 181 of the locking-ring 180. The rail features 166 on the back-pushing ring 160 and counter shape 164 on the expandable gripping ring 161 provides a radial expanding guide for ring sections 179. During the expansion, the ring sections 179 may be separated from each other by the rupture of the thin sections 163. The expansion of the expandable gripping ring will continue preferably up the contact of the anchoring devices 74 to the inner surface of the tubing string 1.

The expansion and longitudinal movement of the expandable gripping ring 161, induces also in turn the expansion of the continuous expandable seal ring 170. The expansion involves the traveling of the inner conical surface 171 over the matching conical surface 181 of the locking-ring 180. The expansion force is transmitted through the contact surface 174 between the expandable gripping ring 161 and the continuous expandable seal ring 170.

During the expansion process of 161 and 170, the locking ring 180 may not move longitudinally as secured in position with the retrievable setting tool 150, and in particular the sections 154.

The actuation force transmission 190 continues as long as an equilibrium is reached with the anchoring devices 74 and the shear devices 65.

Figure 20:
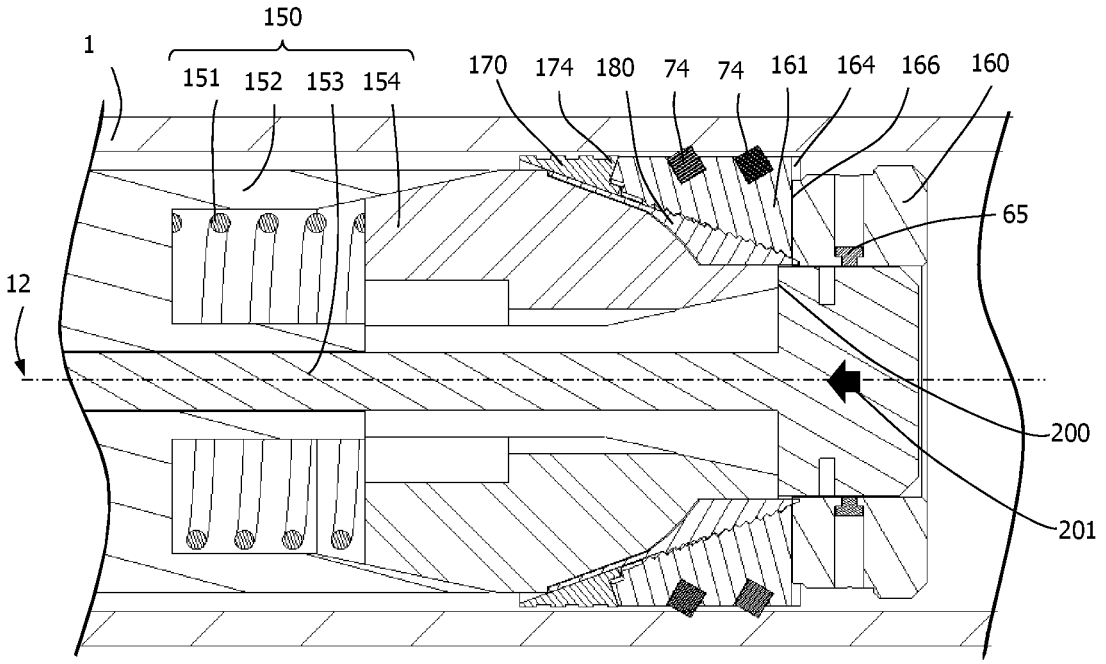
FIG. 20 is a cross-section view of plug assembly in a set stage inside a tubing string with a retrievable setting tool disconnecting from a back-pushing ring.

FIG. 20 is an immediate sequence of FIG. 19. At this moment, the shear devices 65 have sheared, disconnecting longitudinally the rod 153 from the back-pushing ring 160.

The rod may continue its longitudinal movement 201 up to contacting the sections 154 at the contact surface 200.

No other parts depicted in FIG. 20 may have moved compared to the description done for FIG. 19.

Figure 21:
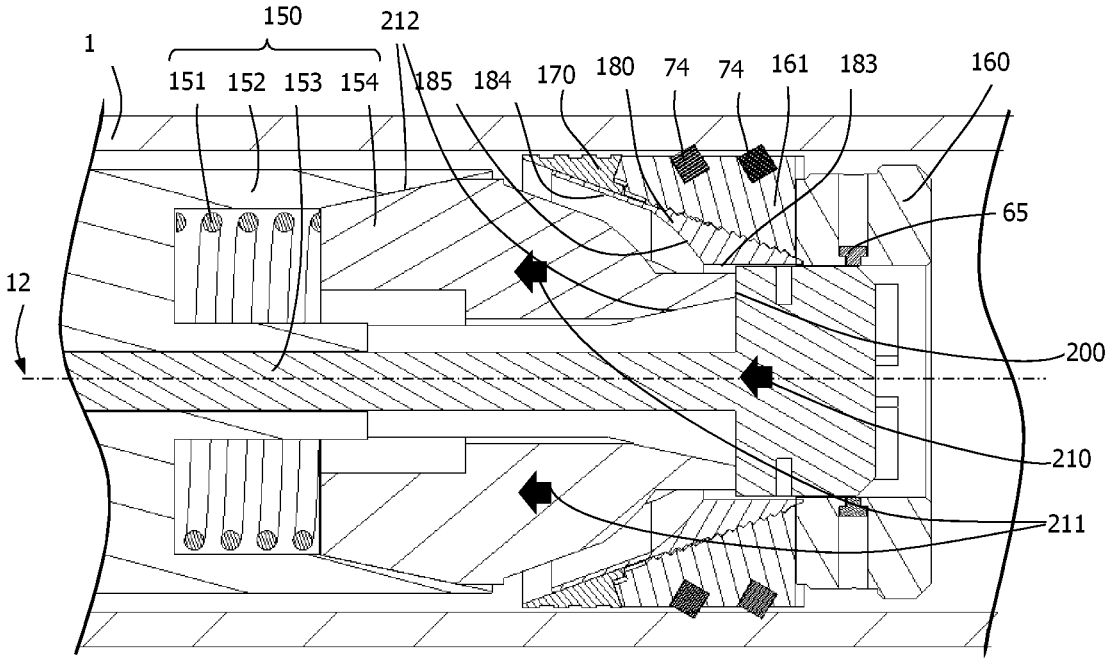
FIG. 21 is a cross-section view of plug assembly in a set stage inside a tubing string with a retrievable setting tool with collapsed sections.

FIG. 21 is a sequence of FIG. 20. At this moment, the further continuous movement 210 of the rod 153, has pushed the sections 154 by contacting the surface 200. The movement of the sections 154 may follow a combined axial and radial movement 211, guided by the surface 212 of the housing 152 and the nose 156. The relative movement of the sections will further be detailed in FIG. 35A to FIG. 38C.

At that point, the locking ring 180 is free from the contact surfaces 184 and 185 with the sections 154 of the retrievable setting tool 150. The locking ring 180, as well as the expandable gripping ring 161 and expandable continuous seal ring 170 are secured in position inside the tubing string 1, thanks to the different locking features described previously in FIGS. 16B, 17B and 18A, namely the teeth or corrugated surfaces 165, 182 along with groove feature 169.

The longitudinal movement of the section 154 also induces the compressing of the spring 151 of the retrievable setting tool 150.

Figure 22:
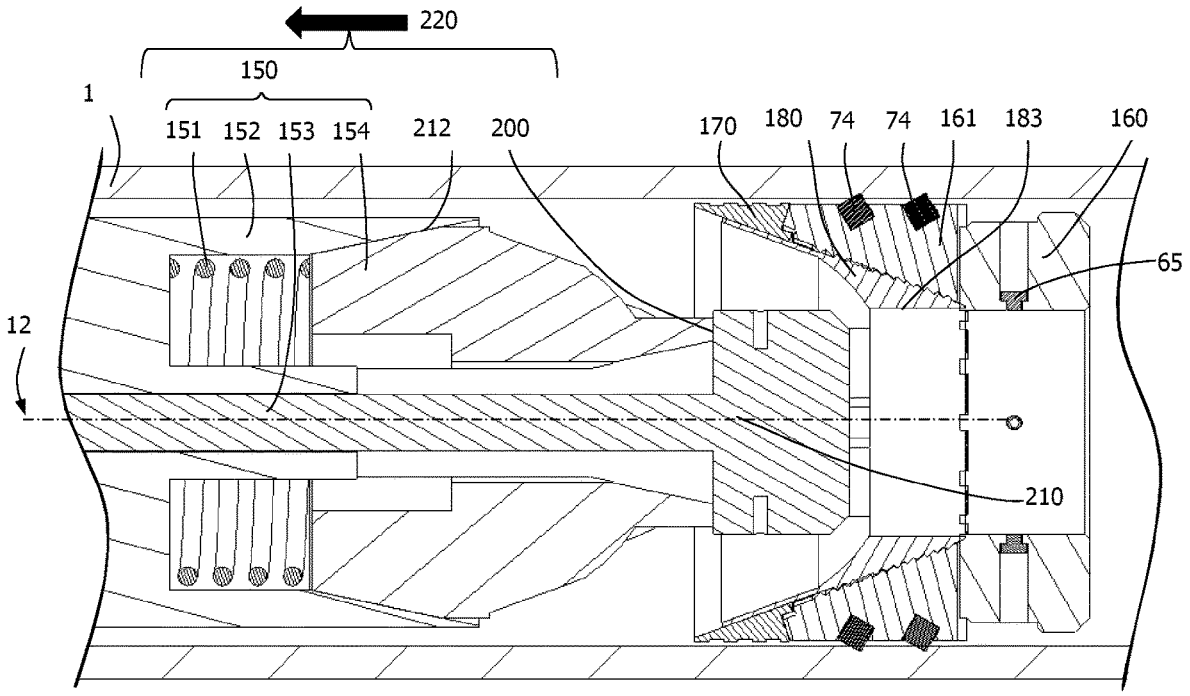
FIG. 22 is a cross-section view of plug assembly in a set stage inside a tubing string with a retrievable setting tool with collapsed sections under retrieval from the plug assembly.

FIG. 22 is a sequence of FIG. 21. It represents the retrieval movement 220 of the retrievable setting tool 150. The retrievable movement 220 is preferably induced from the retrieval of the toolstring 10 as represented in FIG. 2.

The plug parts 170, 180, 161 and 160 may now remain in place inside the tubing string 1.

Figure 23A:
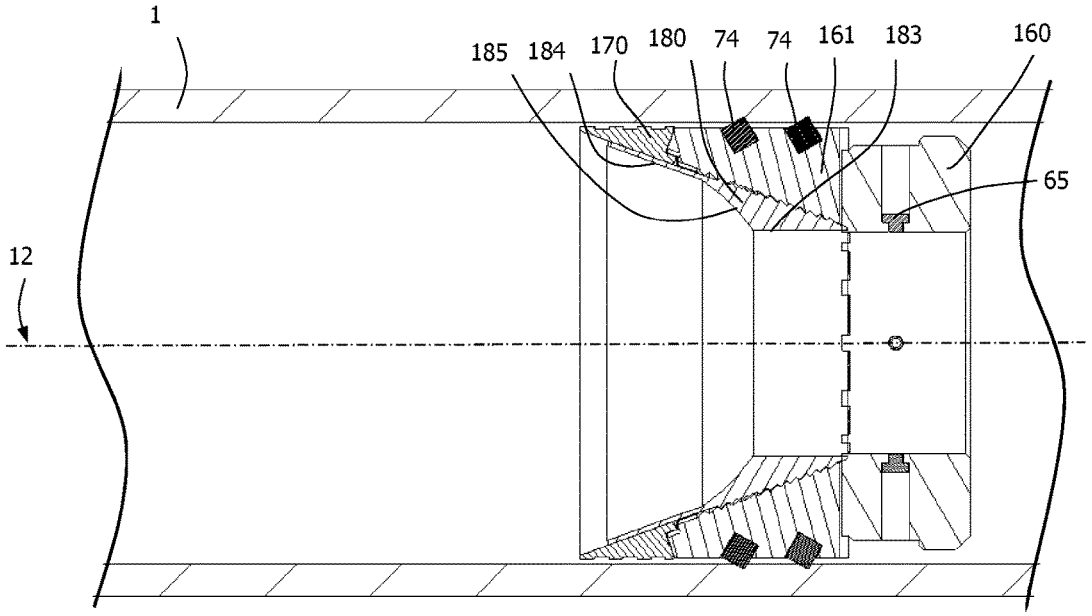
FIG. 23A is a cross-section view of a plug assembly in a set stage inside a tubing string after retrieval of the retrievable setting tool.

FIG. 23A is a sequence of FIG. 22. It represents the set plug inside the tubing string 1. The retrievable setting tool 150 has now been retrieved.

Figure 23B:
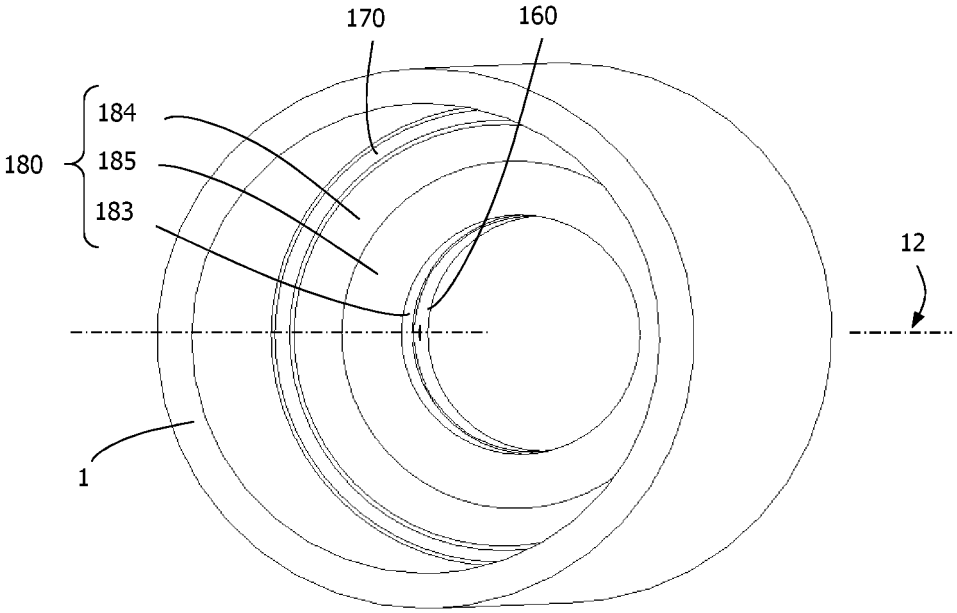
FIG. 23B is an isometric view of the same embodiment as FIG. 23A.

FIG. 23B is an isometric view of FIG. 23A representing the set plug inside the tubing string 1. The view allows representing following surfaces of the locking ring 180: the conical surface 184, the hemispherical surface 185 and the cylindrical surface 183. The expandable continuous seal ring 170 may be visible, as well as the back-pushing ring 160 in the back.

Figure 23C:
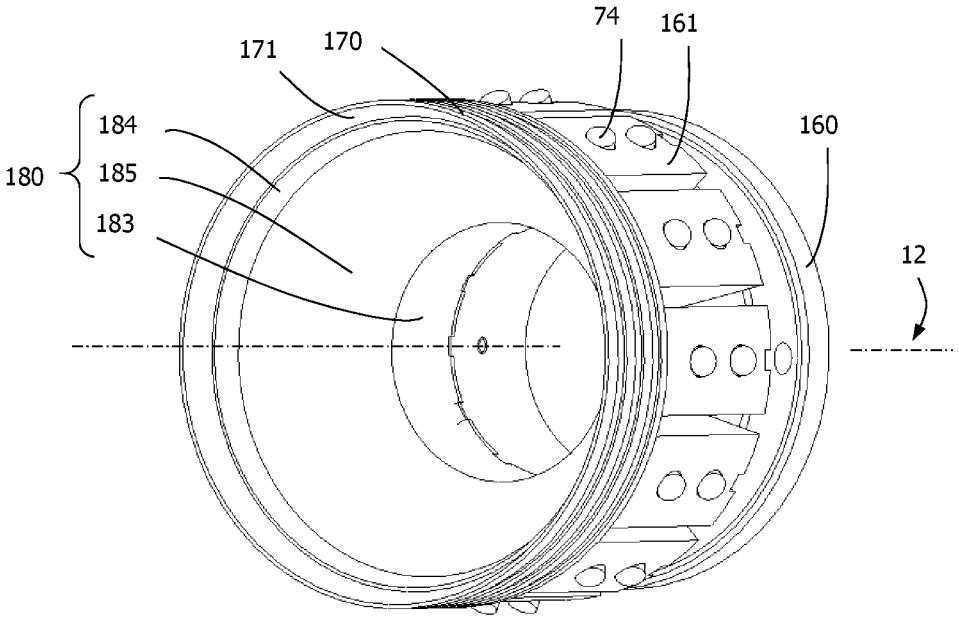
FIG. 23C is an isometric view of the same embodiment as FIG. 23B without showing the tubing string.

FIG. 23C is a similar isometric view as FIG. 23B, without the representation of the tubing string 1. This view represents the set plug with locking ring 180, the expandable continuous seal ring 170, the expandable gripping ring 161 with anchoring devices 74, and the back-pushing ring 160.

Visible inner surfaces are referenced, namely the conical surface 171 of the expandable continuous ring 170, the conical surface 184, the hemispherical surface 185 and the cylindrical surface 183, of the expandable gripping ring 180.

Figure 24A:
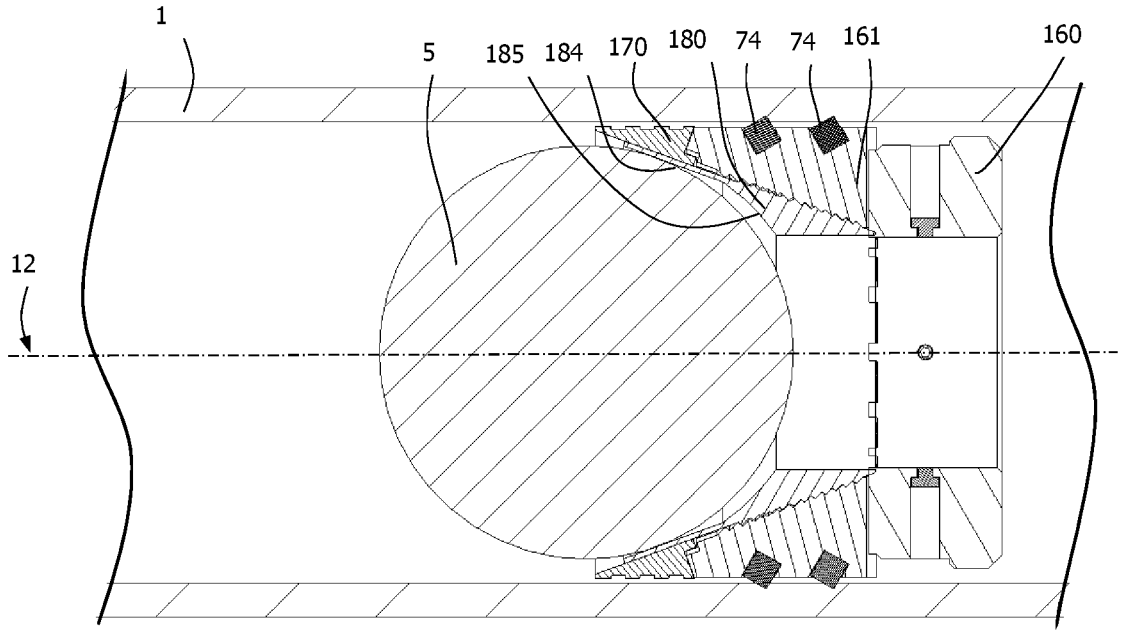
FIG. 24A is a cross-section view of a plug assembly in a set stage inside a tubing string with the landing position of an untethered object.

FIG. 24A is a sequence of FIG. 23A. It represents the same plug as in FIG. 23A with the addition of the untethered object 5.

The untethered object 5 may have the shape of a sphere, or for the purpose of this embodiment only contain a spherical surface which will contact the inner surface 185 of the locking ring 180. As other possible shapes for the untethered object containing a spherical front surface, it may include pill shape or dart shape.

As represented in FIG. 24A, the diameter of the spherical portion of the untethered object 5 may be adapted to contact the conical surface 184 of the locking ring 180, while not contacting the hemi spherical surface 185.

Figure 24B:
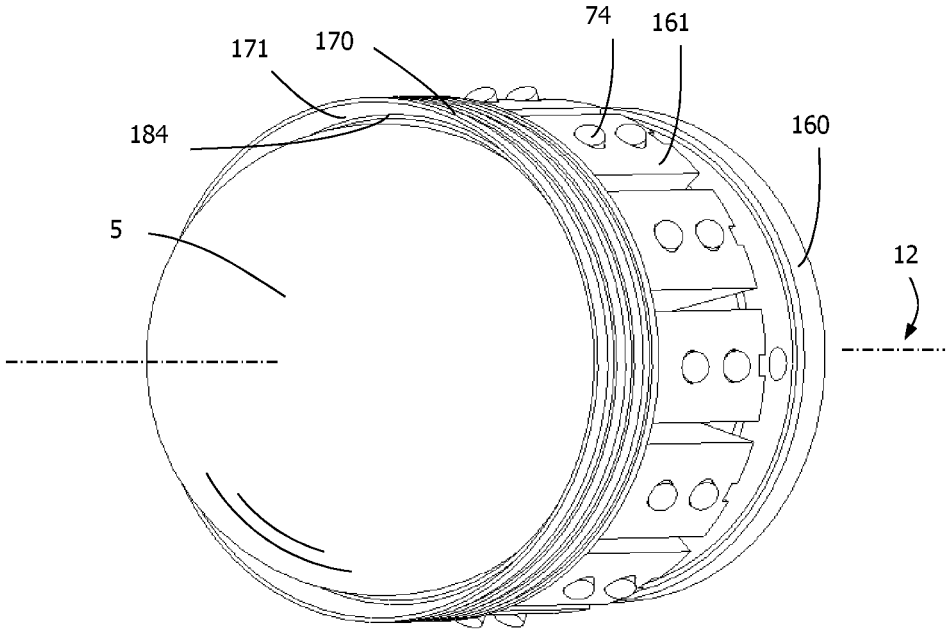
FIG. 24B is an isometric view of the same embodiment as FIG. 24A without showing the tubing string.

FIG. 24B represents an isometric view of FIG. 24A, without the tubing string 1. The figure represents the position of the untethered object 5 as it landed on the plug and contacted the surface 184 of the locking ring 180, while not necessary contacting the inner conical surface 171 of the expandable continuous seal ring 170. The expandable gripping ring 161, along with its anchoring devices 74, and the back-pushing ring, may preferably keep their set position from FIG. 23A.

Figure 24C:
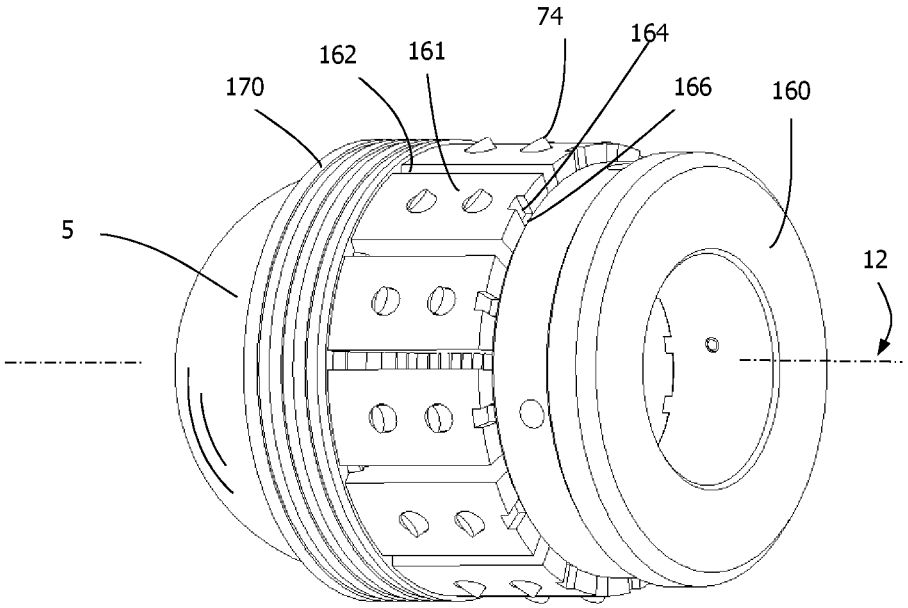
FIG. 24C is another isometric view from the back of the same embodiment as FIG. 24B.

FIG. 24C represents a different orientation of the same embodiment as FIG. 24B. Same components as FIG. 24B are represented. In particular, the position of the rails 164 and 166 with its radial positioning are represented after the expansion of the expandable gripping ring. The slit cuts 162 are consequently wider as depicted in the unset position represented in FIG. 16A.

Figure 25:
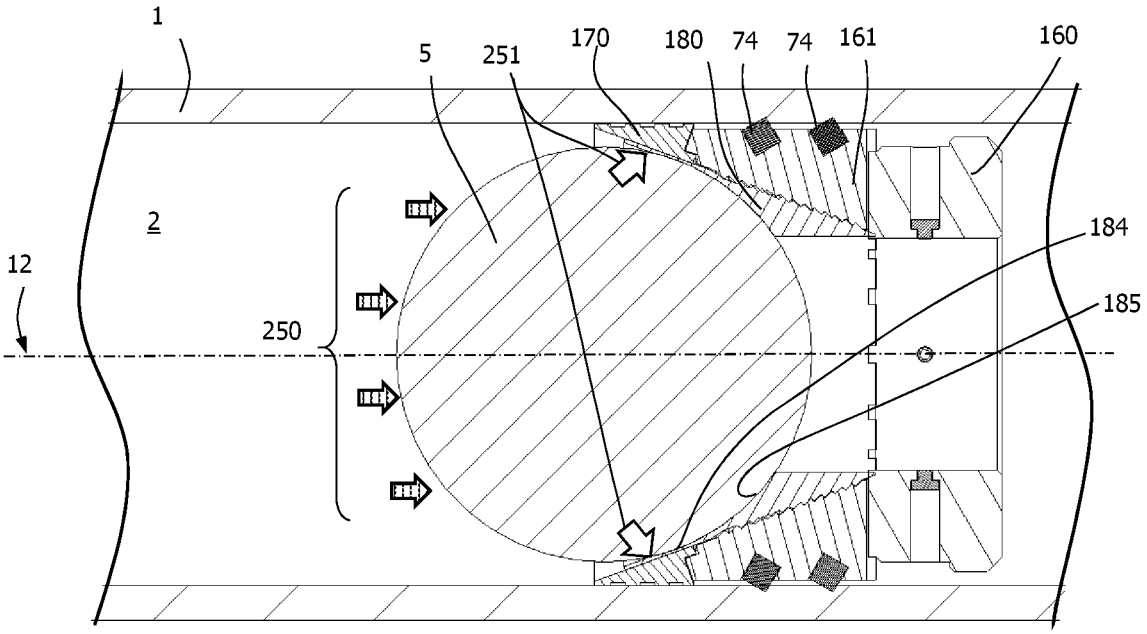
FIG. 25 is a cross-section view of a plug assembly in a set stage inside a tubing string with the untethered object pressing on the plug assembly using well fluid pressure.

FIG. 25 is a sequence of FIG. 24A. It represents the action of the untethered object 5. Through pumping well fluid 2 inside the tubing string 1, such as from surface, the flow restriction constituted by the set plug component 170, 161 and 180, along with the untethered object 5, creates a flow restriction and in turn a pressure 250 on the untethered object, which created a force. This force is transmitted through the contact surface 184 and induces a conical expansion force 251. This force 251 expands the thin section of the locking ring 180 and in turn the inner surface 171 of the expandable continuous seal ring 170. This further expansion of the continuous expandable seal ring may provide enhanced contact surface with the tubing string 1, and consequently enhance the sealing of the plug. The expansion movement of the continuous expandable seal ring may continue as long as the untethered object moves longitudinally inwards through the conical surface 184, and may be stopped at the point where the untethered object 5 contacts the hemispherical surface 185 of the locking ring 180. The other plug components 161 and 160 may not move during this further expansion process of the continuous expandable seal ring 170.

Figure 26A:
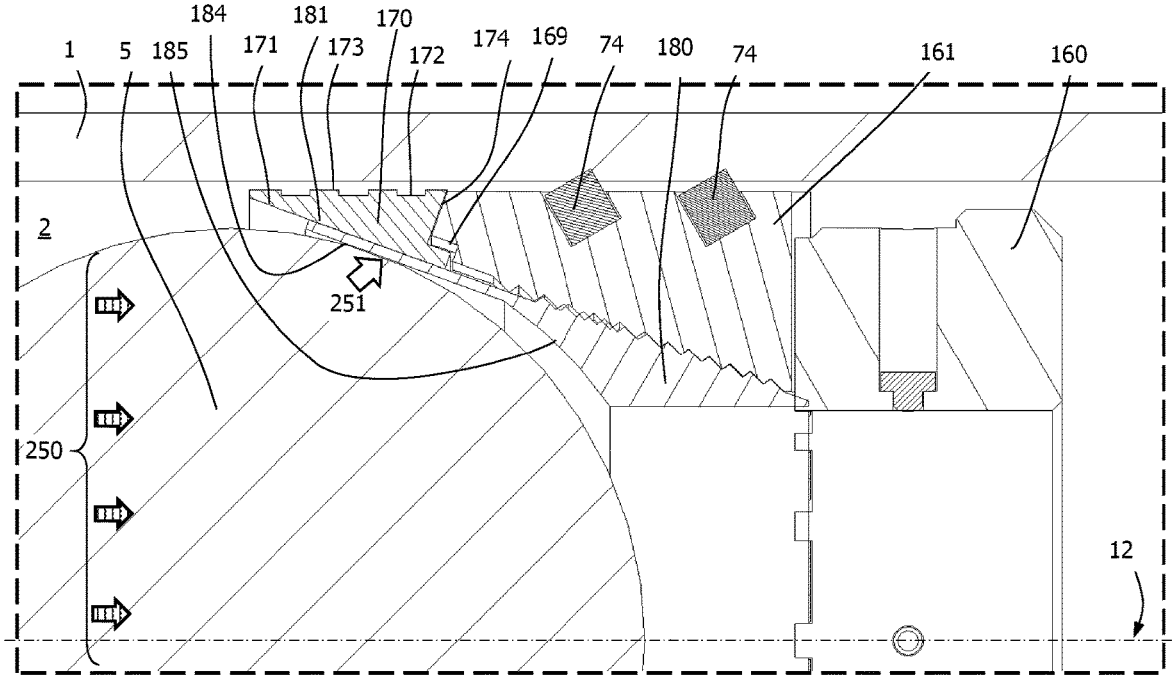
FIG. 26A is a detailed view of a cross-section view of a plug assembly in a set stage inside a tubing string with the landing position of an untethered object.
Figure 26B:
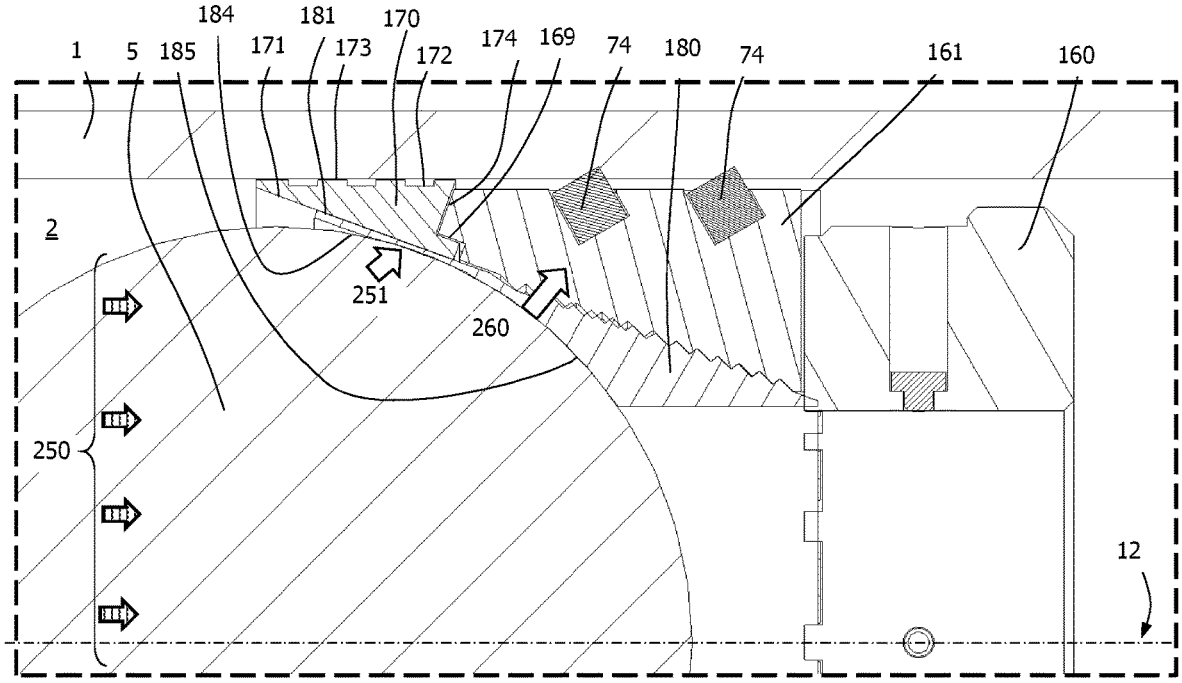
FIG. 26B is a detailed view of a cross-section view of a plug assembly in a set stage inside a tubing string with the untethered object pressing on the plug assembly using well fluid pressure.

FIGS. 26A and 26B represent close-up views of already depicted views in FIGS. 24A and 25.

FIG. 26A shows in detail the untethered object 5 contacting the inner surface 184 of the locking ring 180. The resulting force 251, induced from pressure force 250 on the untethered object 5, is transmitted through the thin section between the surfaces 184 and 181 of the locking ring 180. Assuming a material with sufficient ductility, preferably above 5%, the force 251 is then transferred to the continuous expandable seal ring 170, on its inner conical surface 171. As depicted in FIG. 26A, the continuous expandable seal ring 170 may not contact the inner surface of the tubing string 1. A possible radial gap may be present between the external cylindrical surface 173 of the continuous expandable seal ring 170 and the inner surface of the tubing string 1.

The expandable gripping ring 161 may be locked longitudinally with the anchoring devices 74 penetrating inside the tubing string 1. The expandable gripping ring 161 may be also locked radially with locking ring 180. Therefore, the force 251 acting on the expandable continuous seal ring 170 may be guided along the surface 174 contacting the expandable gripping ring 161. The expandable continuous seal ring 170 may expand further radially following the surface 174, represented as a conical surface. A possible groove 169 on the expandable gripping ring 161 may have a similar radial gap to allow this relative radial movement between both parts 161 and 170.

FIG. 26B shows the possible final position of the untethered object 5. Force 251 has expanded both the thin section of the locking ring 180 and further the expandable continuous seal ring 170 up to contacting the outer surface 173 with the inner surface of the tubing string 1. The expandable continuous seal ring 170 is therefore radially further expanded, following the guiding surface 174. The groove gap 169 may be closed after this expansion. The untethered object 5 may move longitudinally during the expansion process of both the locking-ring 180 and expandable continuous seal ring 170. This longitudinal movement of the untethered object 5 may stop as the untethered object 5 is contacting the hemispherical surface 185 of the locking ring 180. At the point of contact, the expansion process of the locking ring and expandable continuous ring may stop as well, and the force 250 from the untethered object may then be shared between further force 251 and a force 260. The force 260 may be directed from the untethered object 5, towards the locking ring 180 and transmitted to the expandable gripping ring 161, allowing to possibly reinforce the anchoring penetration of the anchoring devices 74 inside the tubing string 1.

Figure 27:
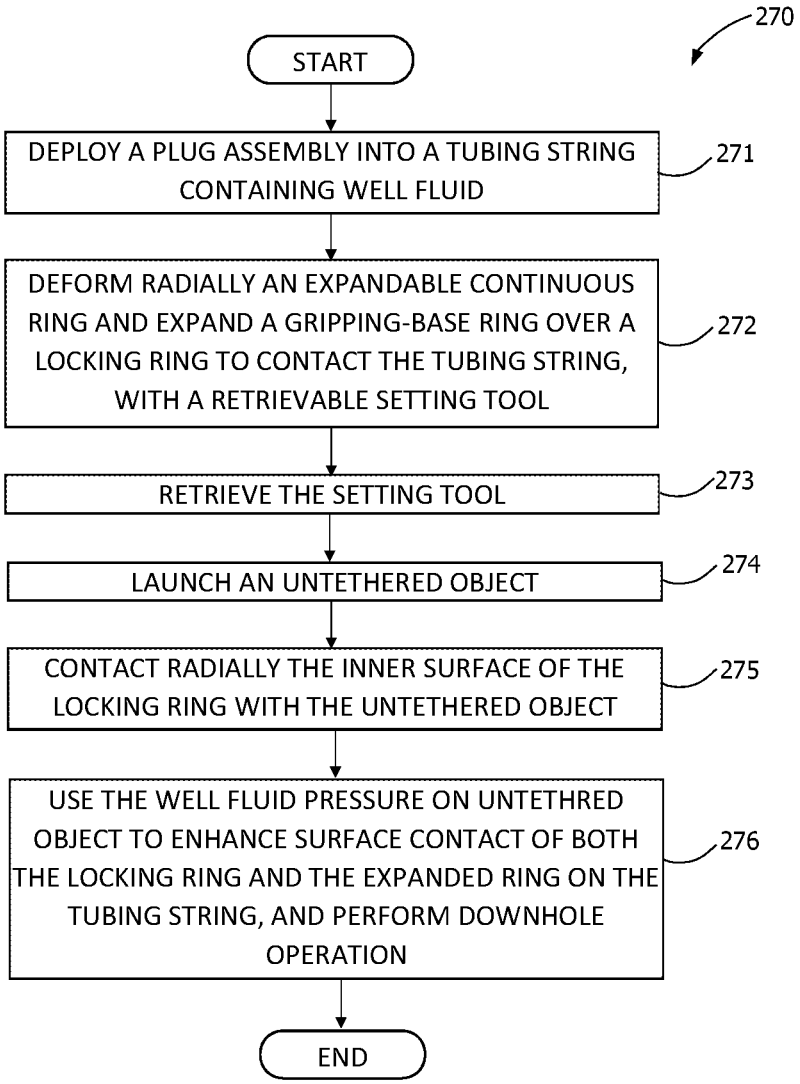
FIG. 27 is a flow diagram representing a technique sequence of deployment of a plug and action of the untethered object on the expandable continuous ring.

FIG. 27 represents a technique sequence 270, which includes major steps depicted in FIG. 15A to FIG. 25.

Step 271 corresponds to the deployment of the plug assembly (170, 180, 161, 160) into the tubing string (1) containing well fluid (2). During step 272, the plug assembly with its expandable continuous seal ring (170) is deformed radially, and the expandable gripping ring 161 is expanded radially, both due to the action of a retrievable setting tool (150), over a locking ring (180). During the same step 272, the expandable gripping ring contacts at least one point of the inner surface of the tubing string (1). Then, during step 273, the retrievable setting tool (150), is retrieved. Further during step 274, an untethered object (5), is launched, such as from surface, inside the tubing string (1). Then, during step 275, the untethered object (5) reaches the position of the set plug in step 272 and contacts radially the inner surface of the locking ring (180). Finally, during step 276, the well fluid (2) pressure and flow restriction up-hole of the untethered object (5) is used to act as a force on both the locking ring (180) and the expandable continuous seal ring (170) to enhance the surface contact with the tubing string (1). This isolation state allows performing a downhole operation inside the well.

Figure 28:
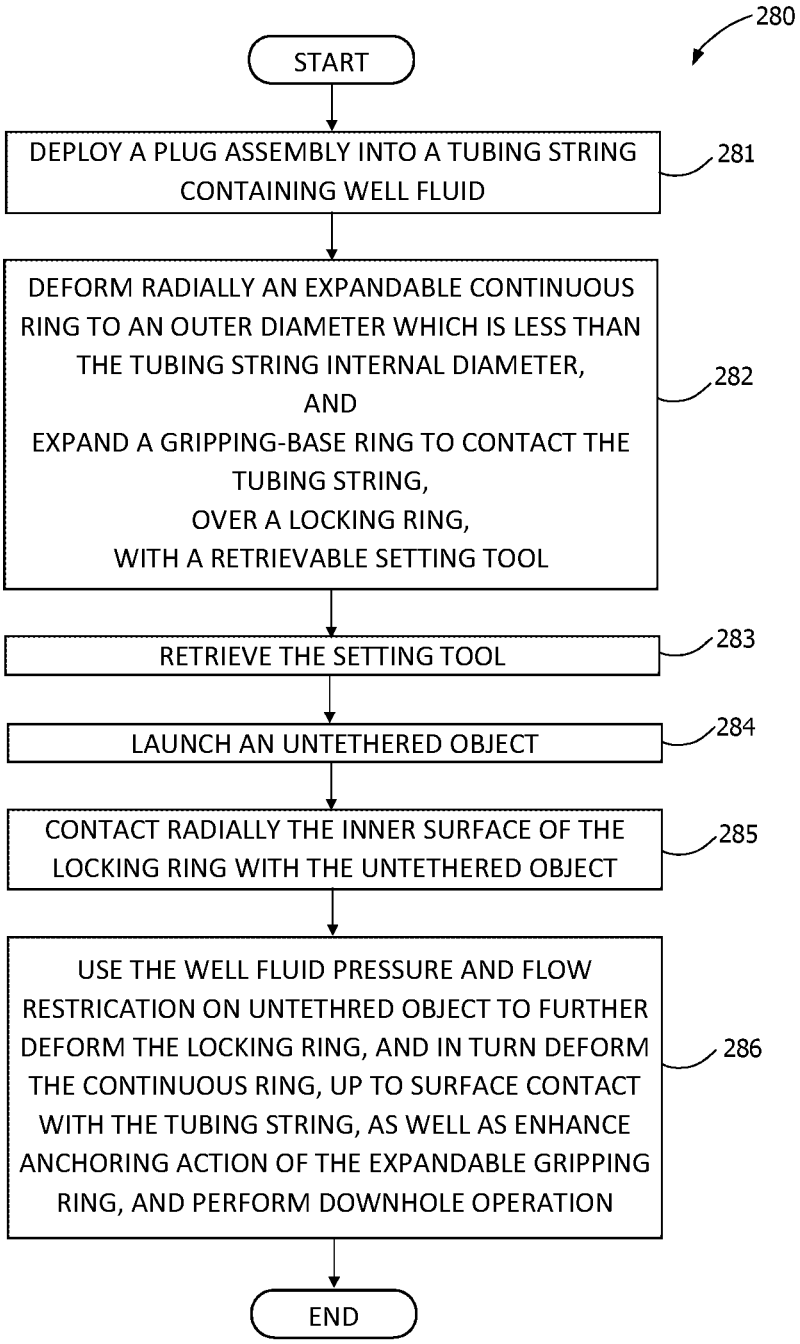
FIG. 28 is a flow diagram representing a technique sequence of deployment of a plug, with the action of an untethered object for further expanding the expandable assembly and contacting a stopping surface on the locking ring.

FIG. 28 represents a technique sequence 280, which includes major steps depicted in FIG. 15A to FIG. 26B.

Step 281 corresponds to the deployment of the plug assembly (170, 180, 161, 160) into the tubing string (1) containing well fluid (2). During step 282, the plug assembly with its expandable continuous seal ring (170) is deformed radially, and the expandable gripping ring (161) is expanded radially, both due to the action of a retrievable setting tool (150), over a locking ring (180). During the same step 272, the expandable gripping ring contacts at least one point of the inner surface of the tubing string (1), while the expandable continuous seal ring (170) is deformed to an outer diameter which is less than the tubing string (1) inner diameter. Then, during step 283, the retrievable setting tool (150), is retrieved. Further during step 284, an untethered object (5), is launched, such as from surface, inside the tubing string (1). Then, during step 275, the untethered object (5) reaches the position of the set plug in step 282 and contacts radially the inner surface of the locking ring (180). Finally, during step 286, the well fluid (2) pressure and flow restriction up-hole of the untethered object (5) is used to act as a force to deform further both the locking ring (180) and the expandable continuous seal ring (170), up to surface contact with the tubing string, allowing further enhanced contact between all plug components from the untethered object (5) to the tubing string (1) passing through the locking ring (180) and expandable continuous seal ring (170). The force also provides enhanced anchoring action on the expandable gripping ring (161). This isolation state allows performing a downhole operation inside the well.

Figure 29:
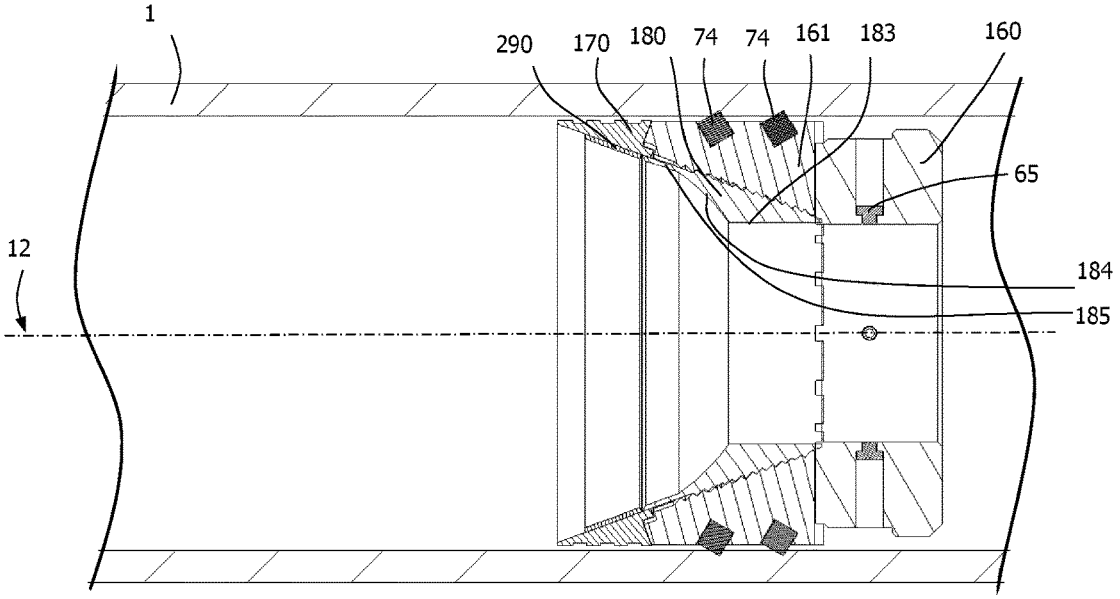
FIG. 29 is a cross-section view of another embodiment of a plug assembly in a set stage inside a tubing string after retrieval of the retrievable setting tool, having a two-section locking ring.
Figure 30A:
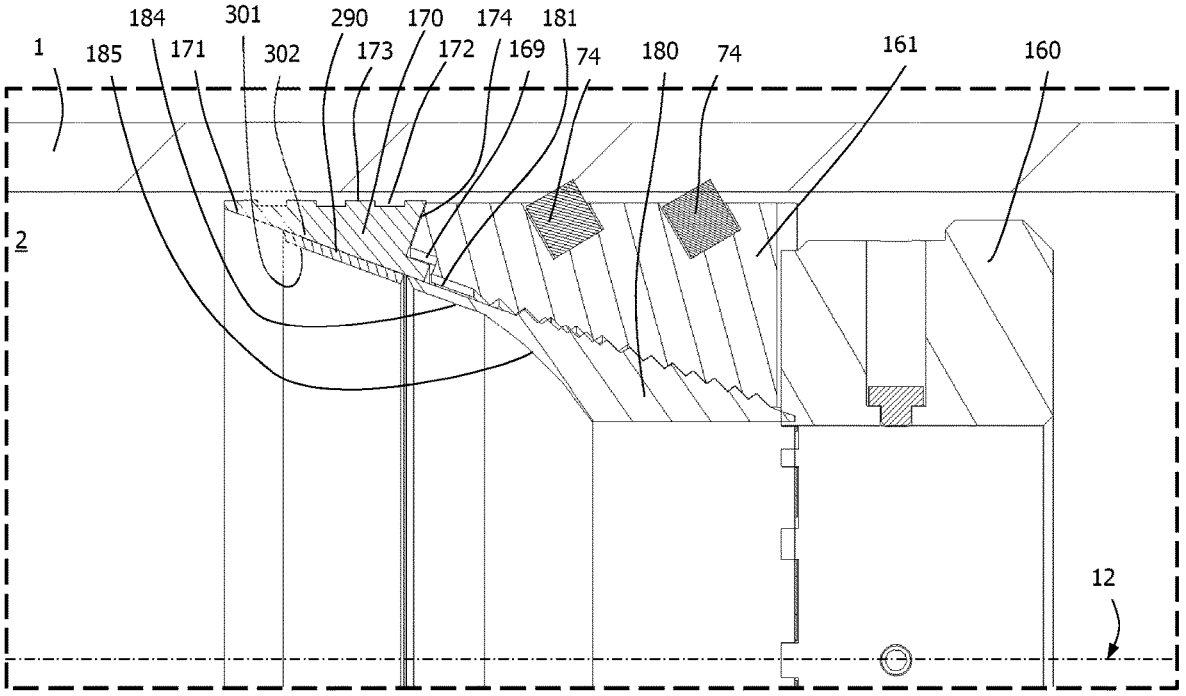
FIG. 30A is a detailed view of FIG. 29.
Figure 30B:
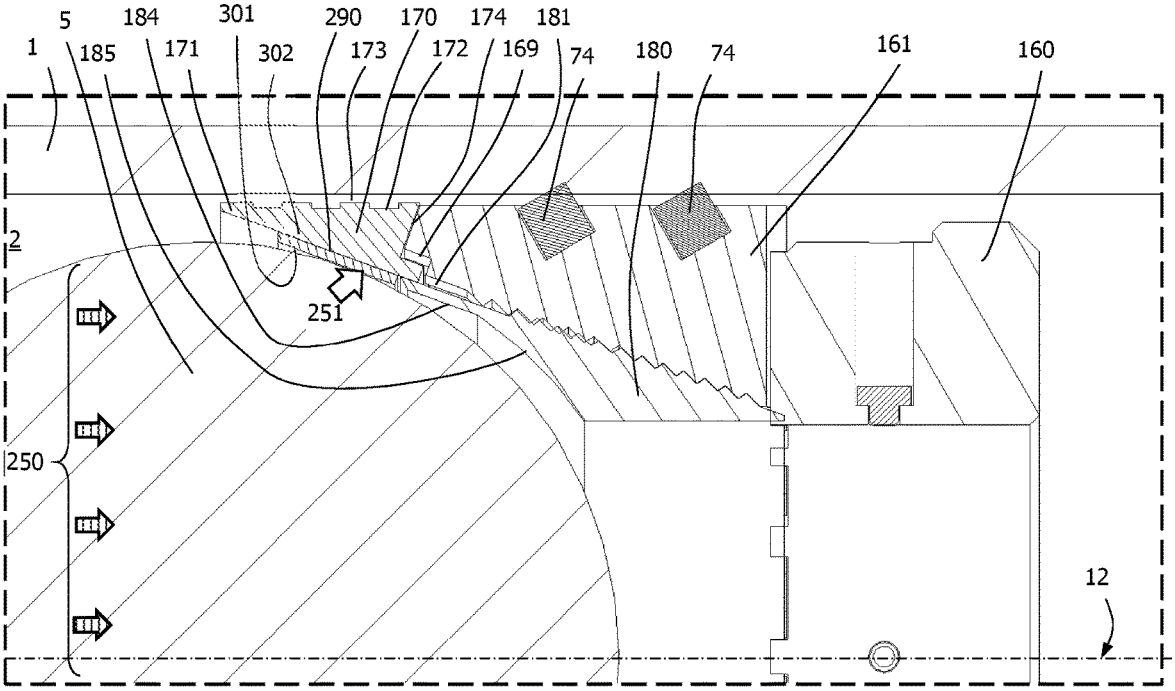
FIG. 30B is a detailed view of a plug assembly with a two-section locking ring in a set stage inside a tubing string with the landing position of an untethered object.
Figure 30C:
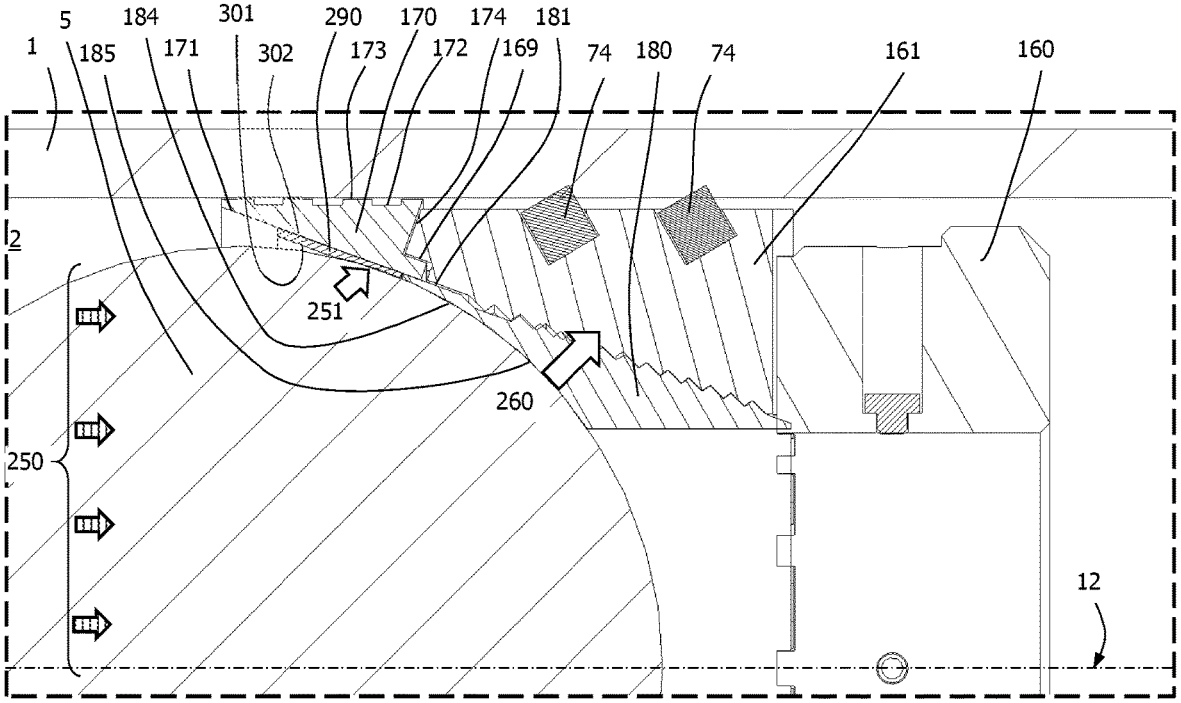
FIG. 30C is a detailed view of a plug assembly with a two-section locking ring in a set stage inside a tubing string with the untethered object pressing on the plug assembly using well fluid pressure.
Figure 31:
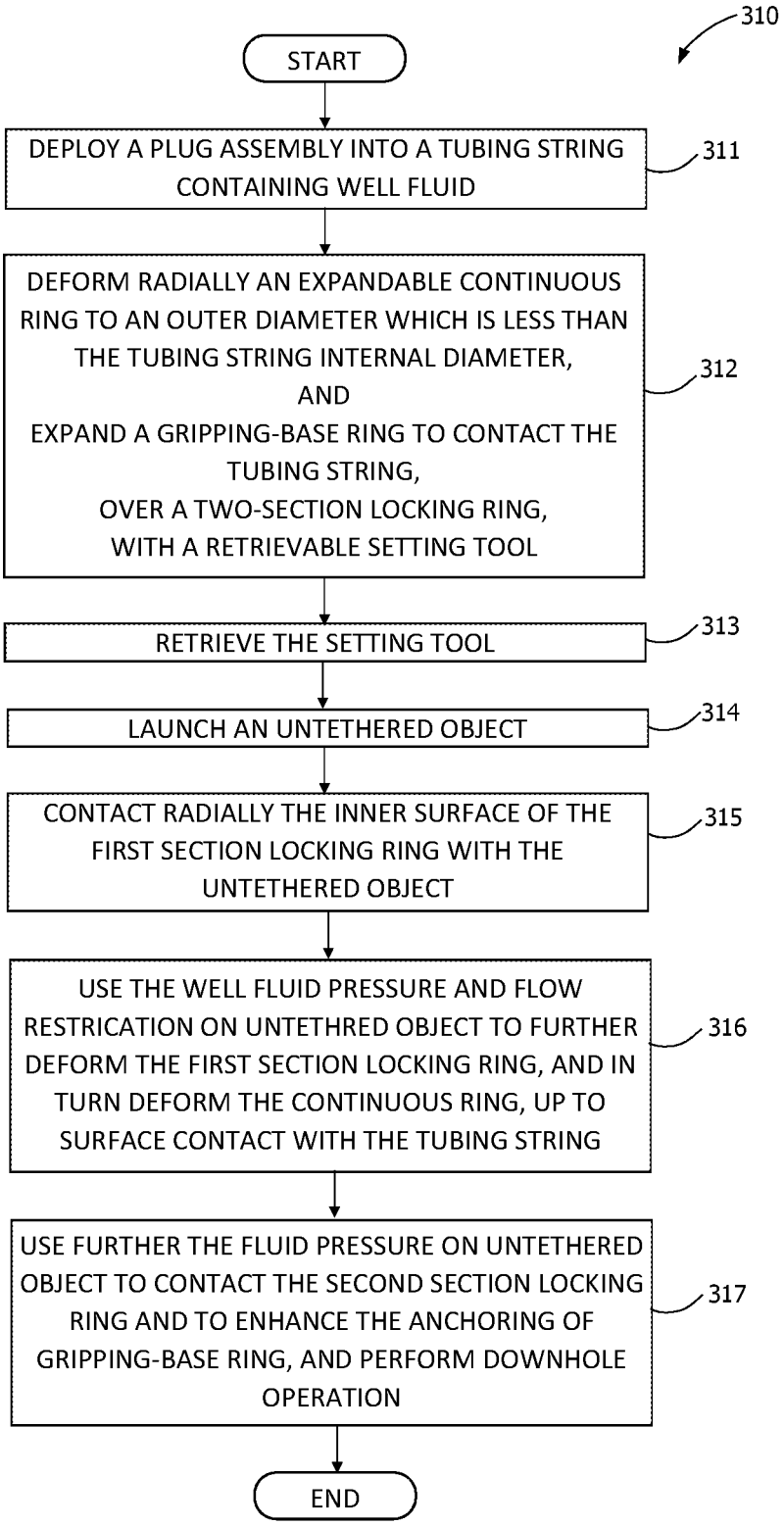
FIG. 31 is a flow diagram representing a technique sequence of deployment of a plug with a two-section locking ring, with the action of an untethered object for further expanding the expandable assembly and contacting a stopping surface on the locking ring.

FIGS. 29 to 31 represent a variation to the previously described embodiment from FIG. 15A to FIG. 26B.

A noticeable difference is a separation in two parts of the locking ring 180.

FIG. 29 represents a set plug, in a similar configuration as FIG. 23A. The locking ring 180 is shorter than in FIG. 23A, and referred to as first section locking ring. A second section locking ring 290 corresponds to the thin section conical shape described in FIG. 18B.

The other parts of the plug, namely the expandable continuous seal ring 170, the expandable gripping ring 161 with its anchoring devices 74, the back-pushing ring 160 with shearing devices 65, remain similar to FIGS. 15A to 26B.

FIG. 30A represents a close-up view of FIG. 29 in the same configuration. The first section locking ring 180 keeps the inner surfaces 185 as hemispherical and 184 as conical. The second section locking ring 290 includes an inner conical surface 301 which may be in the continuity of the inner surface 184 of the first section locking ring 180. The second section locking ring 290 includes an outer conical surface 302 which may be in the continuity of the outer surface 181 of the first section locking ring 180. In this configuration, most of the contact surface 171 with the expandable continuous seal ring 170 occurs with the second section locking ring 290 via the conical surface 302, and most of the contact surface with the expandable gripping ring 161 occurs via the external conical surface 181 of the first section locking ring.

This configuration with two sections locking ring allows for example to adapt the material properties for the first 180 and second 290 section of the locking ring. As the second section 290 might be more exposed to deformation, a choice of more ductile material could be made. Regarding the first section locking ring 180, more exposed to radial loading, a material with higher yield stress might be selected.

FIG. 30B represents the action of an untethered object 5, similar to FIG. 26A previously described.

A difference is the acting of the untethered object 5 through the force 251 which is now contacting the second section 290 of the locking ring. The deformation is now transferred from inner surface 301 towards the outer surface 302 of the second section locking ring 290, and further to the expandable continuous seal ring 170 via its inner surface 171. A similar deformation as described in FIG. 26A can occur, with the expandable continuous seal ring 170 following the trajectory surface 174 of the expandable gripping ring 161. The first section locking ring 180 might not be contacted by the untethered object during this step.

FIG. 30C represents the further action of an untethered object 5, similar to FIG. 26B previously described.

The resulting shape is very similar to FIG. 26B. A difference is that the majority of the force 251 towards the expandable continuous seal ring 170 is transmitted via the second section locking ring 290, and that the majority of the force 260 towards the expandable gripping ring 161 is transmitted via the first section locking ring 180.

Depending on material property choices, some specific goals towards sealing (290, 170) and towards anchoring (180, 161) might be selected to reach the wished performance.

FIG. 31 represents a technique sequence 310, which includes major steps depicted in FIG. 29 to FIG. 30C.

Step 311 corresponds to the deployment of the plug assembly (170, 180, 290, 161, 160) into the tubing string (1) containing well fluid (2). During step 312, the plug assembly with its expandable continuous seal ring (170) is deformed radially, and the expandable gripping ring (161) is expanded radially, both due to the action of a retrievable setting tool (150), over a two-section locking ring (180 and 290). During the same step 312, the expandable gripping ring contacts at least one point of the inner surface of the tubing string (1), while the expandable continuous seal ring (170) is deformed to an outer diameter which is less than the tubing string (1) inner diameter. Then, during step 313, the retrievable setting tool (150), is retrieved. Further during step 314, an untethered object (5), is launched, such as from surface, inside the tubing string (1). Then, during step 315, the untethered object (5) reaches the position of the set plug in step 282 and contacts radially the inner surface of the first section locking ring (290). Then, during step 316, the well fluid (2) pressure and flow restriction up-hole of the untethered object (5) is used to act as a force to deform further both the first section locking ring (290) and the expandable continuous seal ring (170), up to surface contact with the tubing string, allowing further enhanced contact between all plug components from the untethered object (5) to the tubing string (1) passing through the first section locking ring (290) and expandable continuous seal ring (170). Further in step 317, the force coming from the fluid pressure on the untethered object (5) is used to contact the second section locking ring (180) to enhance the anchoring action on the expandable gripping ring (161). This isolation state allows performing a downhole operation inside the well.

Figure 32:
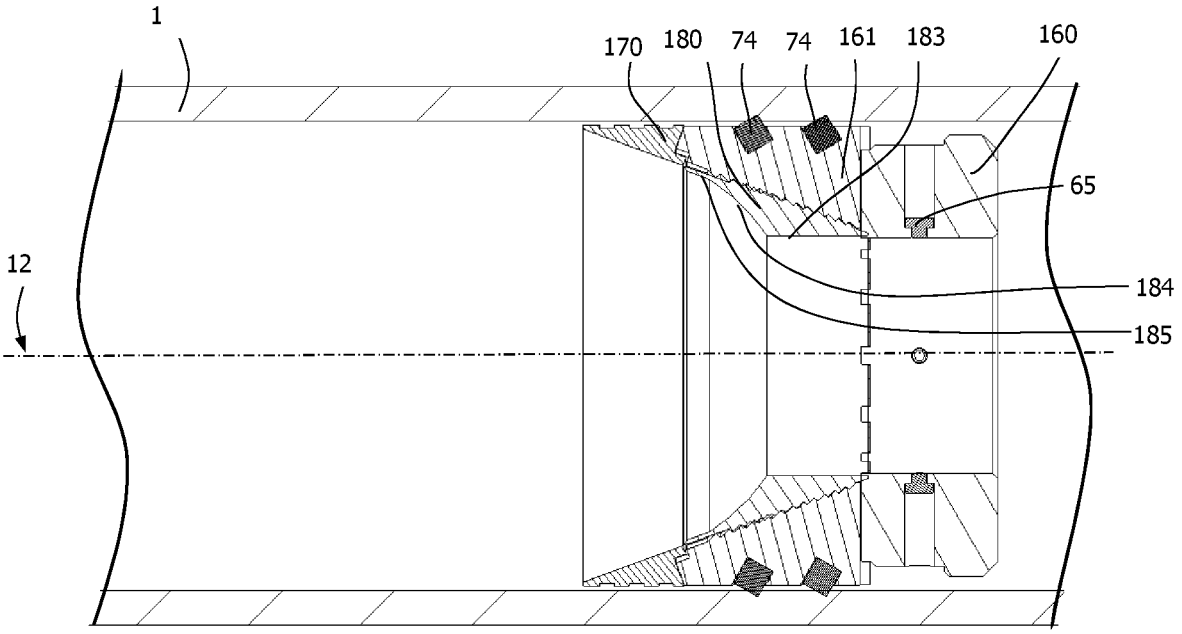
FIG. 32 is a cross-section view of another embodiment of a plug assembly in a set stage inside a tubing string after retrieval of the retrievable setting tool, having a short-length locking ring.
Figure 33A:
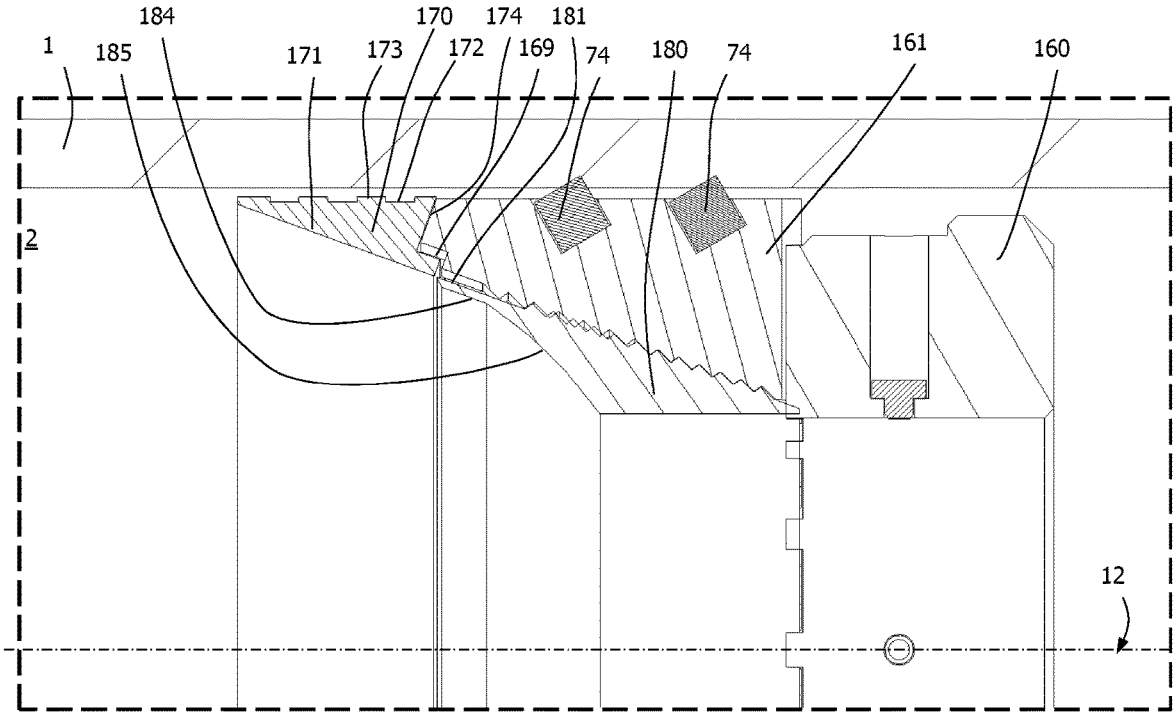
FIG. 33A is a detailed view of FIG. 32.
Figure 33B:
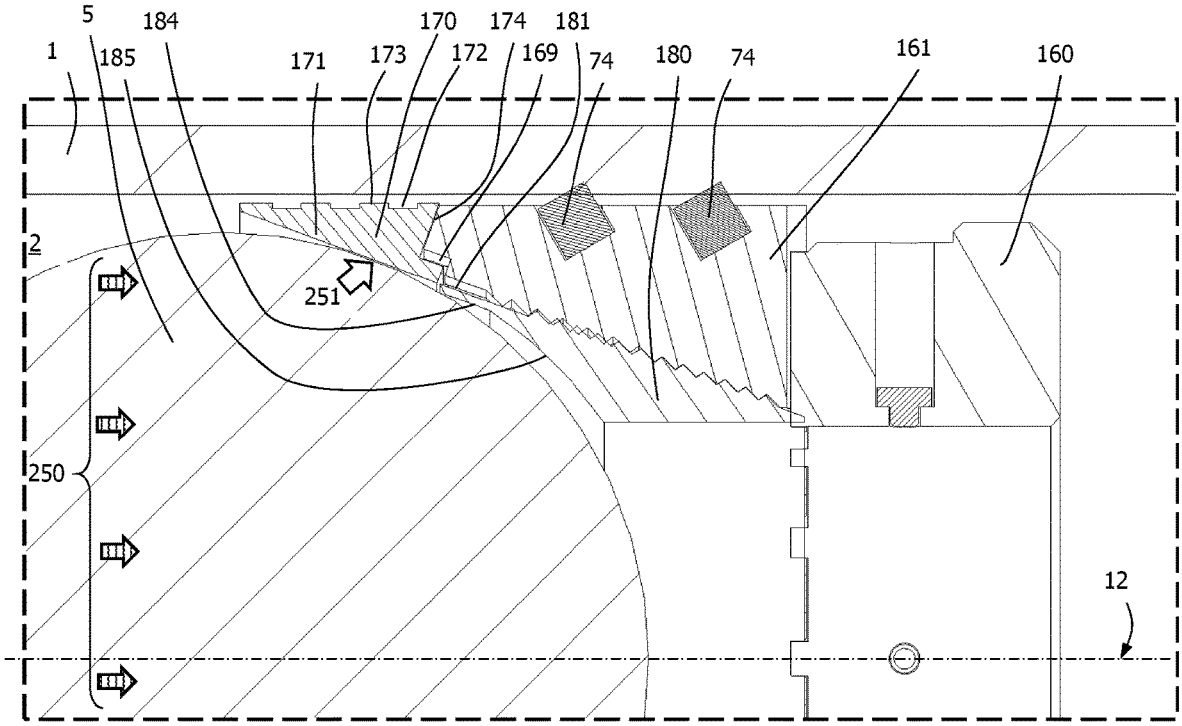
FIG. 33B is a detailed view of a plug assembly with a short-length locking ring in a set stage inside a tubing string with the landing position of an untethered object.
Figure 33C:
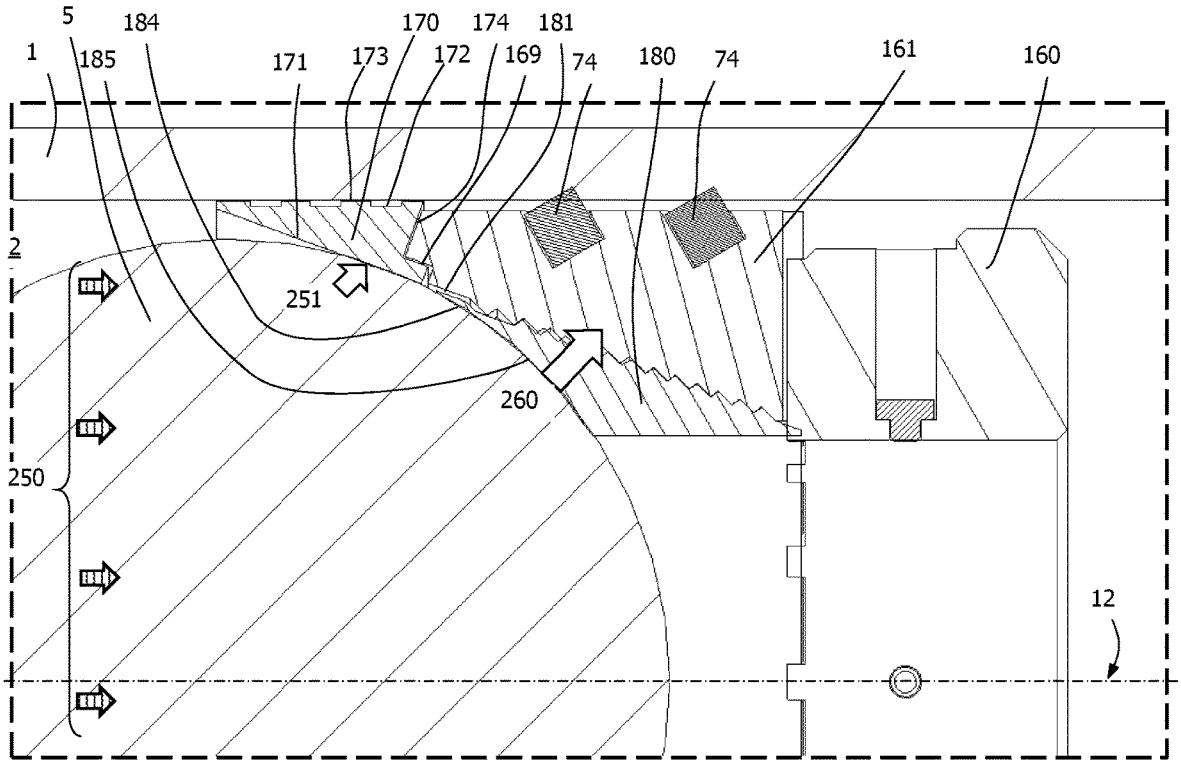
FIG. 33C is a detailed view of a plug assembly with a short-length locking ring in a set stage inside a tubing string with the untethered object pressing on the plug assembly using well fluid pressure.

FIG. 32 to FIG. 33C depict another embodiment.

In this embodiment the locking ring 180 only contains the second section as described in FIGS. 29 to 30C. As a different description, the locking ring 180 can be considered shorter, and in the set plug position not covering the inner surface of the expandable continuous seal ring 170.

FIG. 32 represents the cut view of a set plug with a short locking ring 180. The hemispherical surface 185 as described in FIG. 18B and in FIG. 30 might be kept similar. The conical surface 184 might be smaller in length, compared to FIG. 18B and FIG. 30, with a possible taper towards the part extremity.

The other parts of the plug, namely the expandable continuous seal ring 170, the expandable gripping ring 161 with its anchoring devices 74, the back-pushing ring 160 with shearing devices 65, remain similar to FIGS. 15A to 26B.

FIG. 33A represents a close-up view of FIG. 32 in the same configuration.

A difference compared to previously depicted FIG. 23A or 26A is the length of the locking ring 180. In this configuration, the inner conical surface 171 of the continuous expandable seal ring 170 is not covered by the locking ring thin section. The locking ring 180 has dimensions making the outer surface 181 matching approximately the inner surface of the expandable gripping ring 161. The other features between the expandable continuous seal ring and the expandable gripping ring, like the contact surface 174 and groove 169, remain similar to previously described in FIG. 26A.

FIG. 33B represents a sequence step of FIG. 33A, whereby the untethered object 5 has reached the position of the plug.

In this configuration, the untethered object 5 contacts directly the inner surface 171 of the continuous expandable seal ring 170. The force 251, coming from the fluid pressure 250 acting on the untethered object, acts directly on the continuous expandable seal ring 170 and allow its further deformation.

The reason for not having a second section locking ring or a longer locking ring, as in FIG. 26A or 30B, may be to reduce the number of surface contact to potentially enhance the sealing function. This configuration may need to secure the positioning of the expandable continuous seal ring after its initial expansion and before being constrained by the untethered object. This secure positioning could be achieved by the material choice with possible controlled elastic restraint between the different parts, or by adapting the groove 169 on the expandable gripping ring 161 to constrain longitudinally the movement of the continuous expandable seal ring 170.

FIG. 33C represents a sequence of FIG. 33B and depicts the further action of the untethered object 5 on the set plug.

The force 251 on the untethered object 5 has further radially deformed the continuous expandable seal ring 170, up to contacting its outer surface 173 with the tubing string 1 inner surface. The untethered object moved longitudinally up to contacting the hemispherical surface 184 of the locking ring 180. The force on the untethered object 5 also provides a force component 260 which is directed towards the expandable gripping ring 180 and its anchoring devices 74, enhancing the anchoring action of the embodiment.

Figure 34:
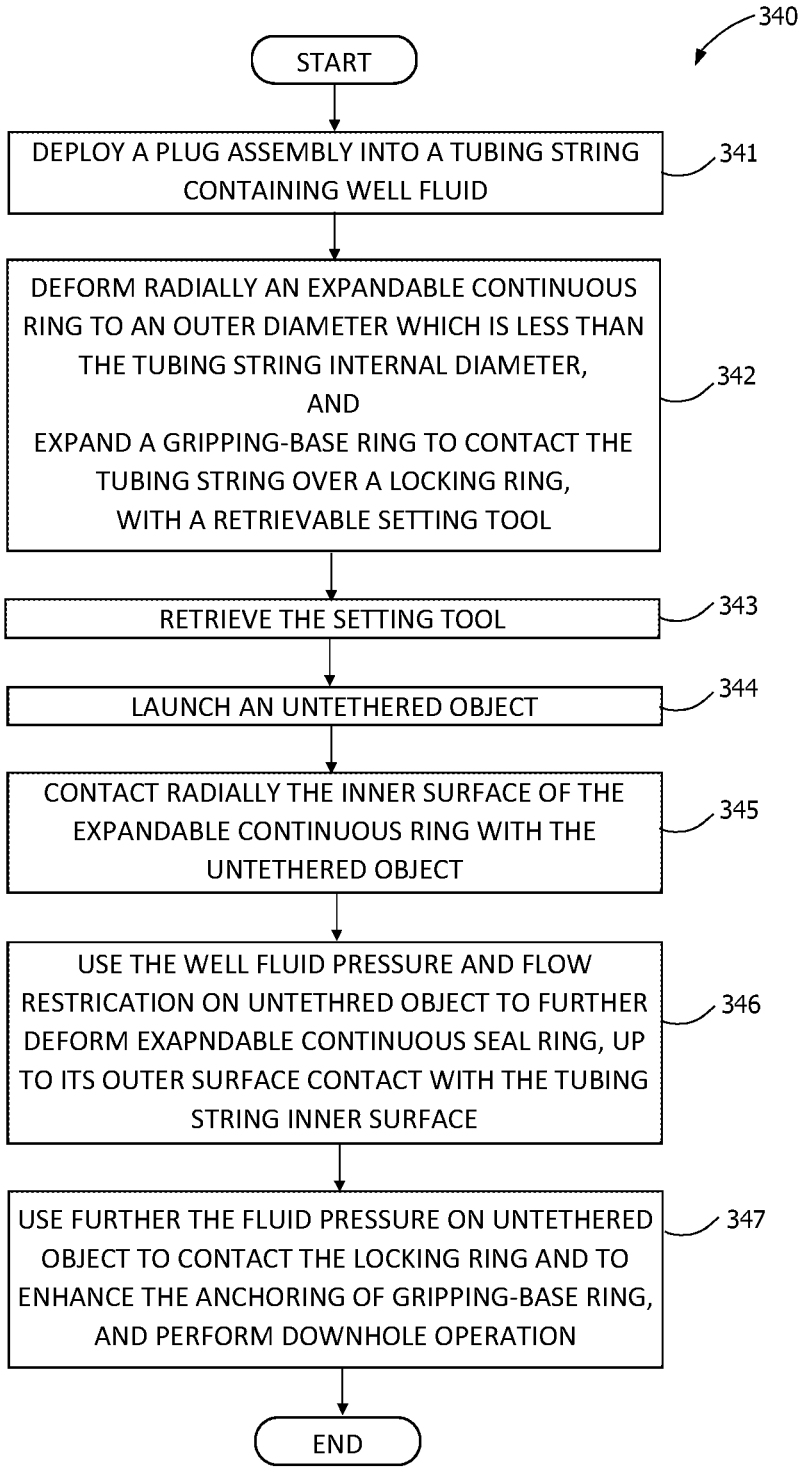
FIG. 34 is a flow diagram representing a technique sequence of deployment of a plug with a short-length locking ring, with the action of an untethered object for further expanding the expandable assembly and contacting a stopping surface on the locking ring.

FIG. 34 represents a technique sequence 340, which includes major steps depicted in FIGS. 32 to 33C.

Step 341 corresponds to the deployment of the plug assembly (170, 180, 161, 160) into the tubing string (1) containing well fluid (2). During step 342, the plug assembly with its expandable continuous seal ring (170) is deformed radially, and the expandable gripping ring (161) is expanded radially, both due to the action of a retrievable setting tool (150), over a locking ring 180. During the same step 342, the expandable gripping ring contacts at least one point of the inner surface of the tubing string (1), while the expandable continuous seal ring (170) is deformed to an outer diameter which is less than the tubing string (1) inner diameter. Then, during step 343, the retrievable setting tool (150), is retrieved. Further during step 344, an untethered object (5), is launched, preferably from surface, inside the tubing string (1). Then, during step 345, the untethered object (5) reaches the position of the set plug in step 282 and contacts radially the inner surface of the expandable continuous seal ring (170). Then, during step 346, the well fluid (2) pressure and flow restriction up-hole of the untethered object (5) is used to act as a force to deform further the expandable continuous seal ring (170), up to its outer surface contact with the tubing string inner surface, allowing further enhanced contact between all plug components from the untethered object (5) to the tubing string (1) passing through expandable continuous seal ring (170). Further in step 347, the force coming from the fluid pressure on the untethered object (5) is used to contact the locking ring (180) to enhance the anchoring action on the expandable gripping ring (161). This isolation state allows performing a downhole operation inside the well.

What is claimed is:

1. A method comprising:

deploying a plug assembly into a tubing string containing well fluid, the plug assembly including:

an expandable assembly, comprising a continuous sealing portion and a gripping portion, a locking ring, including a flared outer surface, wherein the expandable assembly includes at least a first flared inner surface, and wherein the flared outer surface of the locking ring is contacting the first flared inner surface of the expandable assembly;

expanding the expandable assembly over the flared outer surface of the locking ring, whereby the expandable assembly deforms radially until the gripping portion of the expandable assembly contacts at least one point of an internal surface of the tubing string, whereby the continuous sealing portion of the expandable assembly is made entirely of a metallic alloy, and wherein radially deforming the continuous sealing portion of the expandable assembly occurs through plastic deformation of the metallic alloy;

launching an untethered object inside the well fluid of the tubing string;

contacting the untethered object with the plug assembly after the expandable assembly is deformed radially;

applying pressure on the untethered object using the well fluid whereby forces are applied to the expandable assembly so that the continuous sealing portion of the expandable assembly deforms radially;

contacting an inside surface of the tubing string with the continuous sealing portion of the expandable assembly; and penetrating the internal surface of the tubing string at the at least one point with the gripping portion of the expandable assembly.

2. The method of claim 1, further comprising diverting a portion of the well fluid outside the tubing string, or sealing a portion of the well fluid inside the tubing string with the plug assembly.

3. The method of claim 1, further comprising dissolving at least one component of the plug assembly or the untethered object.

4. The method of claim 1, wherein the expandable assembly includes a continuous sealing ring and a gripping ring that are separate, wherein the continuous sealing ring and the gripping ring are coupled longitudinally through a conical or an annular contact surface, wherein an inner surface of the sealing ring is adjacent to an inner surface of the gripping ring, and wherein the inner surface of the sealing ring and the inner surface of the gripping ring form the first flared inner surface of the expandable assembly.

5. The method of claim 1, wherein expanding the expandable assembly occurs through displacing a back-pushing ring.

6. The method of claim 5, wherein the back-pushing ring is contacting the expandable assembly through a conical or an annular surface.

7. The method of claim 5, wherein displacing the back-pushing ring occurs through actuating a retrievable setting tool longitudinally.

8. The method of claim 7, wherein the retrievable setting tool is retrieved prior to launching the untethered object.

9. The method of claim 5, wherein the locking ring and back-pushing ring are integral.

10. The method of claim 9,
wherein the expandable assembly includes a second flared inner surface, and
wherein the second flared inner surface opens in the opposite direction compared to the first flared inner surface.

11. The method of claim 10, wherein the second flared inner surface of the expandable assembly contacts an outer flared surface of an expansion punch provided by a retrievable setting tool.

12. The method of claim 1, wherein contacting the untethered object with the plug assembly occurs on a flared inner surface of the expandable assembly.

13. The method of claim 1, wherein the locking ring includes a flared inner surface.

14. The method of claim 13,
wherein the locking ring includes at least two consecutive sections that are juxtaposed,
wherein each of the at least two consecutive sections has a flared inner surface and a flared outer surface,
wherein the flared inner surface of any of the at least two consecutive sections is adjacent to the flared inner surface of a following one of the at least two consecutive sections, and
wherein the flared outer surface of any of the at least two consecutive sections is adjacent to the flared outer surface of a following one of the at least two consecutive sections.

15. The method of claim 14, wherein contacting the untethered object with the plug assembly occurs on the flared inner surface of one of the at least two consecutive sections of the locking ring.

16. The method of claim 15,
wherein the untethered object includes one or more curved outer surface, and
wherein the curvature of the curved outer surface of the untethered object is larger than the curvature of the flared inner surface of the one of the at least two consecutive sections of the locking ring.

17. The method of claim 1,
wherein the untethered object includes one or more curved outer surfaces, and
wherein the curvature of the curved outer surfaces of the untethered object is larger than the curvature of the flared inner surface of the expandable assembly.

18. A plugging apparatus, for use inside a tubing string containing well fluid, comprising:
a plug assembly including:
an expandable assembly, comprising a continuous sealing portion and a gripping portion,
a locking ring,
wherein the expandable assembly includes at least a first flared inner surfaces,
wherein the locking ring includes a flared outer surface,
wherein the first flared inner surface of the expandable assembly contacts the flared outer surface of the locking ring,
wherein the expandable assembly is adapted to be deformed radially,
whereby the continuous sealing portion is made entirely of a metallic alloy, and
wherein radially deforming the continuous sealing portion of the expandable assembly occurs through plastic deformation of the metallic alloy;
an untethered object,
wherein the untethered object is adapted to contact an inside surface of the plug assembly and, using well fluid pressure, to apply forces to the plug assembly to cause:
radial deformation of the expandable assembly,
contact of an internal surface of the tubing string with the continuous sealing portion of the expandable assembly, and
penetration of the internal surface of the tubing string at least at one point with the gripping portion of the expandable assembly.

19. The apparatus of claim 18,
wherein the expandable assembly includes a continuous sealing ring and a gripping ring that are separate,
wherein the continuous sealing ring and the gripping ring are coupled longitudinally through a conical or an annular contact surface,
wherein an inner surface of the sealing ring is adjacent to an inner surface of the gripping ring and
wherein the inner surface of the sealing ring and the inner surface of the gripping ring form the first flared inner surface of the expandable assembly.

20. The apparatus of claim 18, wherein at least one component of the plug assembly or the untethered object comprise a material dissolvable inside the well fluid.

21. The apparatus of claim 18 further comprising a back-pushing ring and a retrievable setting tool, wherein the retrievable setting tool is adapted to displace the back-pushing ring causing the radial deformation of the expandable assembly over the flared outer surface of the locking ring.

22. The apparatus of claim 18, wherein the untethered object is shaped to contact a flared inner surface of the plug assembly.

23. The apparatus of claim 22,
wherein the untethered object includes one or more curved outer surfaces, and
wherein the curvature of the curved outer surface of the untethered object is larger than the curvature of the flared inner surface of the plug assembly.

24. The apparatus of claim 18, wherein the metallic alloy of the continuous sealing portion of the expandable assembly includes, as mechanical property, a ductility of over 5% elongation.

* * * * *